US007293674B2

(12) United States Patent
Abe et al.

(10) Patent No.: US 7,293,674 B2
(45) Date of Patent: Nov. 13, 2007

(54) DISCHARGE CONTAINER HAVING A SQUEEZABLE AND DEFORMABLE

(75) Inventors: Takayuki Abe, Koto-ku (JP); Takayuki Goto, Koto-ku (JP); Mitsuo Furusawa, Ibaraki (JP); Tsutomu Kobayashi, Ibaraki (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 465 days.

(21) Appl. No.: 10/505,134

(22) PCT Filed: Apr. 30, 2003

(86) PCT No.: PCT/JP03/05511

§ 371 (c)(1),
(2), (4) Date: Nov. 3, 2004

(87) PCT Pub. No.: WO03/093132

PCT Pub. Date: Nov. 13, 2003

(65) Prior Publication Data

US 2005/0155981 A1 Jul. 21, 2005

(30) Foreign Application Priority Data

Apr. 30, 2002 (JP) ..... 2002-128800
Apr. 30, 2002 (JP) ..... 2002-129195

(51) Int. Cl.
*B65D 35/56* (2006.01)

(52) U.S. Cl. ..... 222/105; 222/106; 222/192; 222/481.5; 222/494

(58) Field of Classification Search ..... 222/92, 222/105, 106, 192, 481.5, 490, 494; 132/112, 132/116
See application file for complete search history.

(56) References Cited

U.S. PATENT DOCUMENTS 4,209,027 A * 6/1980 Morganroth ..... 132/212

(Continued)

FOREIGN PATENT DOCUMENTS

EP 0 829 432 A1 3/1998

(Continued)

*Primary Examiner*—Joseph A. Kaufman
(74) *Attorney, Agent, or Firm*—Oliff & Berridge, PLC

(57) ABSTRACT

The technical problem of this invention is to create check valve mechanisms of a simple configuration. Thus, the object of this invention is to provide a discharge container maintaining high productivity, showing good squeeze operation, and having improved outer appearance. The above technical problem and the object of this invention are solved and achieved by a discharge container comprising: a squeezable container 1 having an outer layer 2, an inner layer 3 laminated with the outer layer 2, a container neck 6 disposed on top of the container 1 and used as the flow path 29 for the contents, and an air intake 13 used to introduce outside air into the void between the outer layer 2 and the inner layer 3; an applicator 70 having an applying mechanism and discharge holes 74 for discharging the contents, and having discharge passage 76 communicated with the neck 6; the second check valve mechanism 41 that acts to open or close the flow path 29 so as not to allow the backflow of the contents and the entry of outside air; a base cup 50 having a bottom of its own, a cylindrical wall 51, which is fitted around the bottom cylinder 8, and an air hole 54 that introduces outside air into air intake 13; and the first check valve 40, which is assembled with and fitted to the base cup 50 so as to allow outside air to pass through the air intake 13 but not to allow the backflow of introduced air.

17 Claims, 18 Drawing Sheets

U.S. PATENT DOCUMENTS

| | | | | |
|---|---|---|---|---|
| 5,332,121 | A * | 7/1994 | Schmidt et al. | 222/95 |
| 5,477,985 | A | 12/1995 | Gueret | |
| 5,913,314 | A | 6/1999 | Garrett et al. | |
| 6,581,803 | B1 * | 6/2003 | Yoshimoto et al. | 222/105 |
| 6,675,812 | B1 * | 1/2004 | Wiley | 132/108 |
| 6,959,840 | B2 * | 11/2005 | Iwatsubo | 222/94 |
| 2001/0040173 | A1 * | 11/2001 | Yamamoto et al. | 222/106 |

FOREIGN PATENT DOCUMENTS

| | | |
|---|---|---|
| EP | 1 167 223 A1 | 1/2002 |
| JP | A-4-297264 | 10/1992 |
| JP | A-06-507870 | 9/1994 |
| JP | A-9-175566 | 7/1997 |
| JP | Y2-02-595396 | 5/1999 |
| JP | A-2000-177767 | 6/2000 |
| JP | A-2000-281112 | 10/2000 |
| JP | A-2002-36344 | 2/2002 |
| JP | A-2002-80055 | 3/2002 |
| JP | A-2002-114279 | 4/2002 |
| JP | A-2003-312730 | 11/2003 |

* cited by examiner (a)

(b)

DISCHARGE CONTAINER HAVING A SQUEEZABLE AND DEFORMABLE

TECHNICAL FIELD

This invention relates to a discharge container capable of discharging the contents without allowing outside air to creep in the container, and in particular, to the discharge container comprising a squeezable and deformable container consisting of an outer layer molded in a certain shape and an inner layer laminated with the outer layer in a peelable manner and also comprising a base cup to be fitted around the bottom cylinder of this container in a combined structure.

BACKGROUND OF THE INVENTION

Various containers are in use to discharge the contents from the container, by squeezing the body of the container with fingers or by utilizing a pump fitted to the neck of the container.

There are laminated containers used to discharge the contents, and these containers comprise an outer layer and a peelably laminated inner layer. The inner layer of such a container breaks away from the outer layer and is deformed with the decrease in the contents. At that time, outside air is introduced into the void between the outer and inner layers.

However, in these containers of the laminated structure, in which the inner layer is peelable from the outer layer, the inner layer is deformed with the decrease in the volume of the contents. Because of this deformation, the deformed inner layer blocks the flow path and prevents the contents from being discharged. In addition, another problem is that the deformed inner layer gets less pressurized with the decrease in the contents even if the outer layer is squeezed hard, thus preventing smooth contents-discharging operation.

As a result that the smooth discharge operation is prevented, more contents are left unused, thus creating a problem that the contents cannot be utilized to the last drop.

The inside of some container remains at a reduced pressure after the inner layer has been deformed with the decrease in the contents. In that case, the outer layer fails to restore its original shape, thus creating another problem of bad outer appearance.

Still other problems come up if an air hole is formed to introduce outside air into the void between the outer and inner layers. Firstly, the production cost shows a steep rise because some changes in the design of the molding machine are required. Secondly, troublesome after-mold processes are required to shape the air hole. Since the number of processes has to be increased for the completion of the product, the production and processing become complicated.

This invention has been made to solve these problems found in conventional art. The technical problem of this invention is to create check valve mechanisms that are readily feasible in the containers of the laminated structure. Thus, the object of this invention is to provide a discharge container maintaining high productivity, showing good squeeze operation, and having improved outer appearance.

DISCLOSURE OF THE INVENTION

According to an exemplary aspect, to solve the above-described technical problems exists in the configuration: that the container of this invention is used to discharge the contents; and that this container has an outer layer; an inner layer laminated with the outer layer in a manner that the inner layer is peelable from the outer layer; a container neck that is disposed on top of the container and used to form a flow path for the contents; an air intake disposed in the part of the outer layer constituting a bottom cylinder and used to introduce outside air into the void between the outer layer and the inner layer; a base cup fitted around the bottom cylinder; and the first check valve, which is assembled with and fitted to this base cup so as to allow outside air to pass through the air intake but not to allow the backflow of introduced air.

According to the exemplary aspect, the inner layer is deformed as the contents are discharged from the container. Because of this deformation, a void is formed between the outer and inner layers. Then, the first check valve opens to introduce outside air into the void between the outer layer and the inner layer.

Even if an air intake is opened in the bottom cylinder of the container, rather than in the neck, the bottom cylinder of the container is reinforced by the base cup, which is fitted around the bottom cylinder. This base cup has the bottom of its own and stably keeps the bottom of the discharge container in shape.

Once the void between the inner and outer layers has been filled with air, the first check valve acts to block the connection between the air intake and outside air and prevents the backflow of air that has been introduced into the void. Since the void between the inner and outer layers remains filled with air, good outer appearance is maintained.

According to a further exemplary aspect, the container is made deformable and squeezable and that the second check valve mechanism is disposed in the neck of the container to open or close the flow path in such a manner that makes it impossible for the discharged contents to flow back and for outside air to creep inside the container.

According to the further exemplary aspect, the second check valve has blocked up the flow path, but when the body of the squeezable container is squeezed, the second check valve opens to allow the contents to be discharged. The discharge of the contents comes to a halt as soon as the pressure is released. The outer layer begins restoring its original shape because of a resilient recovering force. The second check valve acts to block up the flow path and to prevent the entry of outside air and the backflow of the contents into the container, when the release of the pressure has put the inside of the container under a reduced pressure.

At that time, the inner layer has a reduced capacity and remains deformed with the decrease in the contents. As a result, pressure reduction takes place in the void between the outer layer that begins restoring its original shape and the inner layer that remains deformed because of a reduced capacity. Under the reduced pressure condition, the first check valve opens to introduce outside air into the void between the outer and inner layers through the air intake disposed in the bottom cylinder of the container. The outer layer quickly returns to its original shape with the help of the introduced air and the resilient recovering force of the outer layer itself.

After the outer layer has restored its original state, the body of the container can be squeezed again. This second squeeze puts the void between the outer and inner layers under a pressurized condition. This pressure is applied on the first check valve to block up the connection between the air intake and outside air, and at the same time, prevents air in the void from escaping outside. When the body of the container is squeezed for the second time, the pressure is steadily applied onto the contents inside the deformed inner layer through the air existing between the outer layer and the inner layer. As a result, the second check valve again opens the neck of the container so that the contents are discharged from the discharge port.

According to another exemplary aspect, a concave groove is circumferentially disposed around the outer wall of the bottom cylinder of the container, that an O-ring is tightly fitted around this concave groove, and that the base cup is tightly fitted around the bottom cylinder of the container through the intermediary of this O-ring.

According to the another exemplary aspect, the O-ring is disposed on the wall of the bottom cylinder of the container as the means of tightly fitting the cylindrical base cup wall around the bottom cylinder. After air has been introduced between the outer and inner layers of the container, this O-ring ensures that outside air comes into the void between the outer layer and the deformed inner layer through the air intake, and prevents inside air from escaping through the gap between the base cup and the bottom cylinder of the container.

When the container is squeezed, there is no air leak through the gap between the base cup and the bottom cylinder of the container. Therefore, the contents can be reliably pressurized by the squeeze of the outer layer through the air existing between the inner layer and the outer layer.

According to a further exemplary aspect, the base cup has a cylindrical cup-like shape having the bottom of its own. An air hole is disposed in the bottom plate of this base cup in order for outside air to be introduced through this hole.

According to the further exemplary aspect, an air hole is disposed in the base cup bottom, which is tightly fitted around the bottom cylinder of the container. In this configuration, the base cup stably reinforces the bottom cylinder of the container. The first check valve mechanism can be fitted to the base cup favorably and easily.

According to another exemplary aspect, the first and second check valve mechanisms are composed, respectively, of a ring, the fitting part, and the valve, which is connected to the ring and connectors and is moved up or down, with the connectors being fixed to the ring at the outer ends to serve as rear anchors.

According to the another exemplary aspect, elasticity of the connectors can be set so freely that the check valve mechanisms are able to move at any desired sensitivity, and the movements are stable and steady.

According to a further exemplary aspect, the first and second check valve mechanisms comprise a ring, which is the fitting portion, and a slit plate, which is formed integrally together with the ring and is provided with a slit having the valve function.

According to the further exemplary aspect, the check valves can be obtained easily at a less expensive cost because the check valve mechanisms have a simple configuration.

According to another exemplary aspect, the first check valve mechanism is provided with a gasket, which is integrally molded together with the first check valve from a soft, elastic material. This gasket is fitted around the bottom cylinder of the container and fitted inside the cylindrical wall of the base cup so that the base cup is tightly fitted around the bottom cylinder of the container.

According to the another exemplary aspect, the first check valve mechanism and the gasket are integrally molded from a soft, elastic material. As a result, the gasket is held tight between the bottom cylinder of the container and the cylindrical wall of the base cup. Therefore, the gasket prevents the introduced air from escaping through the gap between the base cup and the bottom cylinder of the container.

According to a further exemplary aspect, a pinch-off portion is formed in the outer layer along the parting line under the bottom plate of the container bottom cylinder and that this pinch-off is opened and used as the air intake.

Outer-layer parison and inner-layer parison with no mutual compatibility are co-extruded to obtain laminated parison, which is pressed flat by the mold pinch-off to give the pinch-off portion. A bottom crack takes place readily in this pinch-off portion. According to the further exemplary aspect, this crack can be formed in the outer layer without any troublesome after-mold processing and can be used as the air intake.

If the pinch-off portion is opened and used as the air intake after this portion has been formed along the parting line on the bottom, then the bottom cylinder of the container remains cracked in the bottom. In this invention, however, the base cup having the bottom of its own is fitted around the container bottom cylinder for the reinforcement. The base cup also stably holds the shape of the container bottom cylinder, without causing any inconvenience, such as the degraded sitting function.

According to another exemplary aspect, the base cup is provided with a pressing mechanism, which applies a pressure onto the bottom plate of the container in the direction of the parting line.

According to the another exemplary aspect, when the base cup is fitted around the bottom cylinder of the container, the pressing mechanism of the base cup enables a crack-like slit to be opened along the parting line in the pinch-off portion of the outer layer that makes up the bottom plate of the container. As it is, this open slit can be used as the air intake.

According to a further exemplary aspect, a discharge section is fitted to the neck of the container and is used to form a discharge passage for the contents, which connects between the flow path and the discharge port.

According to the further exemplary aspect, the discharge section is fitted into the neck of the container. Since any desired discharge port can be formed by means of this discharge section, it is possible to form a discharge section that can flexibly respond to any intended purpose.

For example, the discharge section may be formed to have a discharge port of a narrow passage so that the contents can be discharged in drops. The discharge container having such a discharge port is suitably used as an eyedropper.

According to another exemplary aspect, an applicator is provided so that the contents are discharged from the discharge port of the discharge member and are applied onto the target surface.

According to the another exemplary aspect, the contents can be discharged from the container and applied easily because an applicator is utilized to apply the contents directly on the intended surface.

According to a further exemplary aspect, the applicator is a comb attachment comprising a row of teeth, discharge holes for discharging the contents into the interspaces of the teeth, and a discharge passage, which is disposed inside the comb spine and is connected to the flow path inside the discharge section.

According to the further exemplary aspect, the contents are discharged to the interspaces of the teeth, and thus can be applied directly to the hair by means of the comb attachment. This makes the application onto the hair quite simple.

The discharge holes may be disposed in the interspaces of a row of teeth and at regular intervals on one side or top of the comb spine having an inside discharge passage. Each tooth may also be provided with an inside discharge passage reaching the middle point of the tooth height, and a discharge hole may be disposed at the middle point of the tooth height and in the direction of the row of teeth. Or, an elliptical brush with the inside discharge passage is formed and is provided with rows of teeth that stand over one side of this brush, and the discharge holes may be disposed at the middle part of the brush so that the contents can be applied by means of the surrounding teeth.

According to another exemplary aspect, teeth are disposed on one side of the spine.

According to the another exemplary aspect, the contents can be applied to the hair by holding the body of the container with a hand to comb the hair in a manner similar to ordinary combing because the teeth are disposed on one side of the spine.

According to a further exemplary aspect, the teeth stand on top of the spine.

According to the further exemplary aspect, the teeth disposed on top of the spine makes it easy to mold integrally the comb having the discharge holes and the teeth so that the contents can be discharged in the interspaces of the teeth.

According to another exemplary aspect, the applicator is a brush, which has hair implanted on the upper surface of tapered cylinder disposed at the discharge port of the discharge section.

According to the another exemplary aspect, the brush-like applicator can be used to apply the discharged contents directly onto the surface.

According to a further exemplary aspect, an internal stopper comprises a top wall in the shape of a ring, which is disposed at the upper end of the inletting cylinder to be tightly fitted into the container neck and is used as the valve seat for the second check valve mechanism, and also comprises an intermediary cylinder, which stands up from the periphery of the top wall and is connected to the discharge section.

According to the further exemplary aspect, the second check valve mechanism can be fitted properly and easily in the configuration having the discharge section.

According to another exemplary aspect, the internal stopper comprises an opening cylinder, which is suspended from the inner edge of the top wall of the inletting cylinder, and also comprises a rod, which has a passageway to allow the contents to pass between the rod and the opening cylinder.

According to the another exemplary aspect, the discharge section is fitted tightly into the neck of the container by way of the internal stopper, which is provided with the rod that forms a passageway to allow the contents to flow through the inner opening. When the contents are discharged, the inner layer breaks away from the outer layer and tends to be drawn toward the inner opening cylinder where a strong suction force is in action. The rod prevents the inner opening from being blocked up by the inner layer that has been drawn to the inner opening. Even if the inner layer is continuously deflated and deformed with the decrease in the contents, the rod securely maintains the flow path for the contents so that the contents can be discharged to the last drop.

According to a further exemplary aspect, the second check valve mechanism comprises a slit, which is used as an opening and is disposed on the peak of a headed cylinder to be assembled with and tightly fixed to the discharge cylinder of the discharge section.

According to the further exemplary aspect, the slit at the peak of the headed cylinder opens to discharge the contents when the inside of the container is under a pressurized condition. Then, when the pressure ceases to exist in the container, the slit closes under the reduced pressure condition to prevent the backflow of the contents and the entry of outside air into the container. Since the peak of the headed cylinder can be used as a valve, a check valve of quite a small diameter can be provided. Thus, it becomes possible for the second check valve mechanism to be located at a position fully close to the discharge port that has been opened at the tip of a slim discharge cylinder.

According to another exemplary aspect, eye drops are put in the container of this invention.

According to the another exemplary aspect, the outer layer of the container quickly restores its original shape because of the function of the first check valve. Even if the container is of a small size, it has the ease of operation. Furthermore, because the second check valve prevents outside air from creeping inside the inner layer, the container is highly sanitary and most suitable for use as an eyedropper.

BRIEF DESCRIPTION OF THE DRAWINGS

FIG. 9(*b*) is a partially enlarged longitudinal section of the container bottom showing the slit opened in the pinch-off portion to be used as the air intake.

FIG. 12(*b*) is a partly enlarged view of the bottom portion of the discharge container in the same state as shown in FIG. 12(*a*).

PREFERRED EMBODIMENTS OF THE INVENTION

Figure 1:
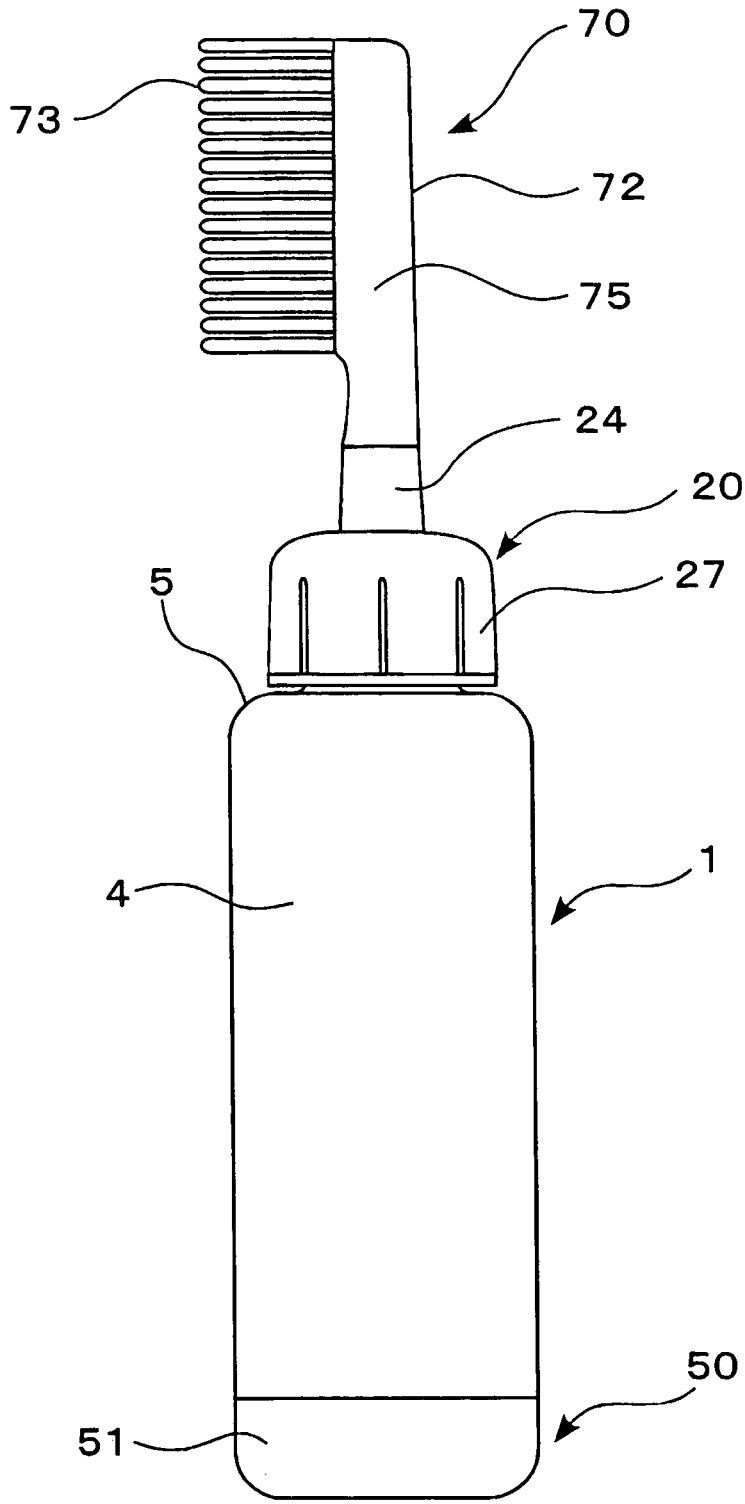
FIG. 1 is a front elevational view of the discharge container in the first embodiment of this invention.

This invention is further described with respect to preferred embodiments, now referring to the drawings.

FIG. 1 is a front elevational view of the discharge container in the first embodiment of this invention. The discharge container comprises the container 1, the connecting member 20 fitted to the neck 6 of the container 1, a comb attachment 72 fitted and fixed to the connecting member 20, and the base cup 50 fitted tightly around the bottom cylinder 8 of the container 1.

Figure 2:
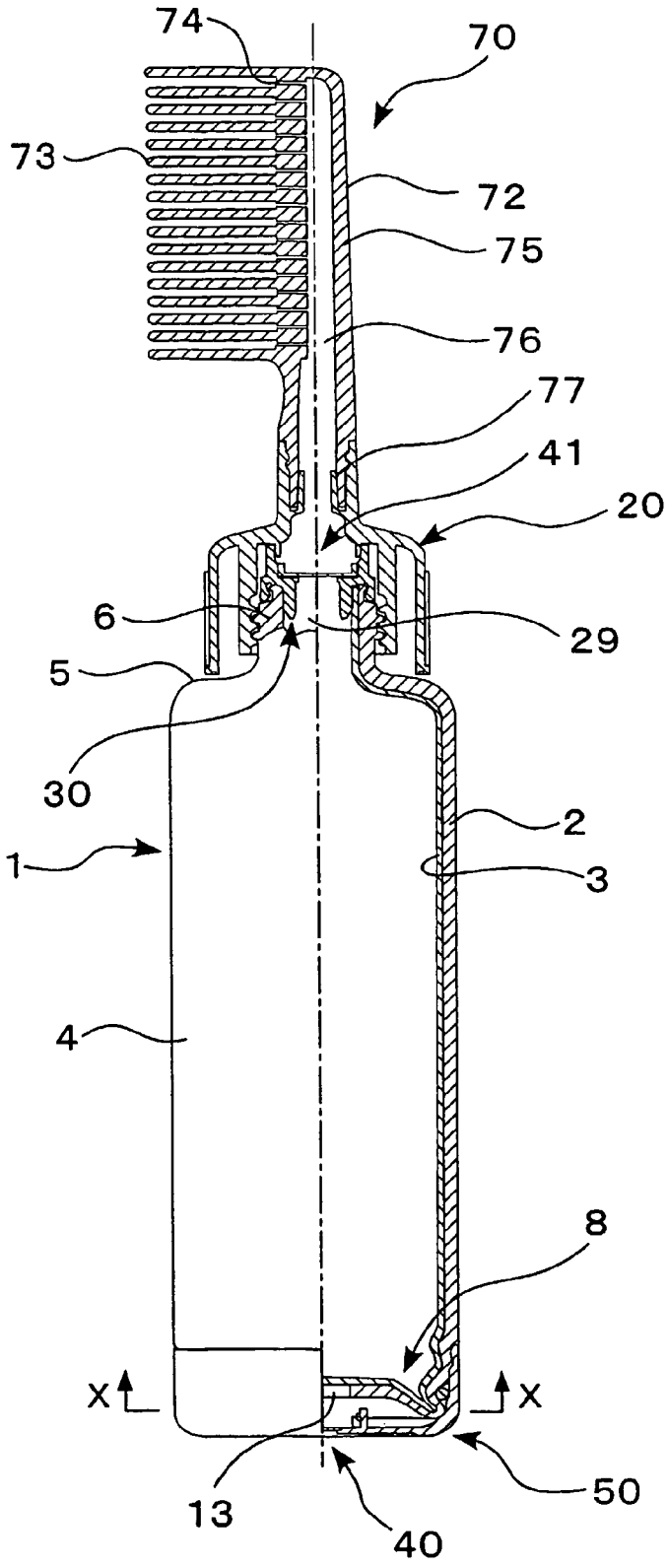
FIG. 2 is an irregular longitudinal section of the discharge container in the first embodiment of this invention shown in FIG. 1.

FIG. 2 shows the upper and lower portions of the discharge container of FIG. 1 in the longitudinal section, with the right half of the body and the bottom portion being also illustrated in the same way. The container 1 has a laminated structure and comprises the outer layer 2 capable of being resiliently deformed by the squeeze and being restored from this deformation. The container 1 also comprises the inner layer 3, which is made of a synthetic resin having so low a level of compatibility with the outer layer 2 that the inner layer 3 is capable of breaking away from the outer layer 2 and undergoing deflationary deformation. The short cylindrical neck 6 of the container 1 is disposed on the shoulder 5 in the upper portion of the body 4. The neck 6 is provided with a screw thread notched on the outer wall and also with a catching groove and peripheral projecting ridge segments, both of which are peripherally disposed above the screw thread (See FIG. 4).

Figure 3:
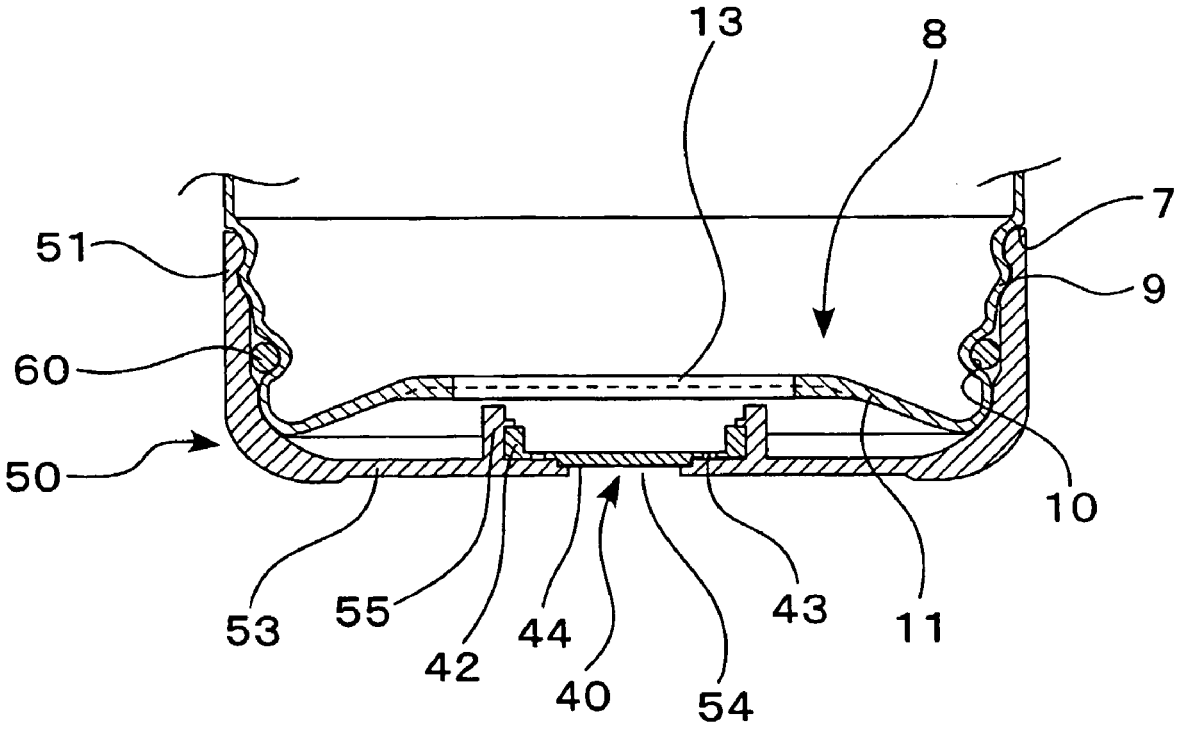
FIG. 3 is a partially enlarged longitudinal section of the important portion at the bottom of the discharge container shown in FIG. 2.

The container bottom 8 of a bottomed cylindrical shape is disposed under the lower end of the body 4 through the intermediary of the overhang 7 (See FIG. 3). An engaging portion is circumferentially disposed at the upper end of peripheral bottom wall 9 of the bottom cylinder 8. A concave groove 10, in which to fit the O-ring 60, is circumferentially disposed below the engaging portion. An air intake 13 is opened in the outer layer 2 of this bottom cylinder 8 to allow outside air to flow in the void between the inner layer 3 and the outer layer 2.

Figure 4:
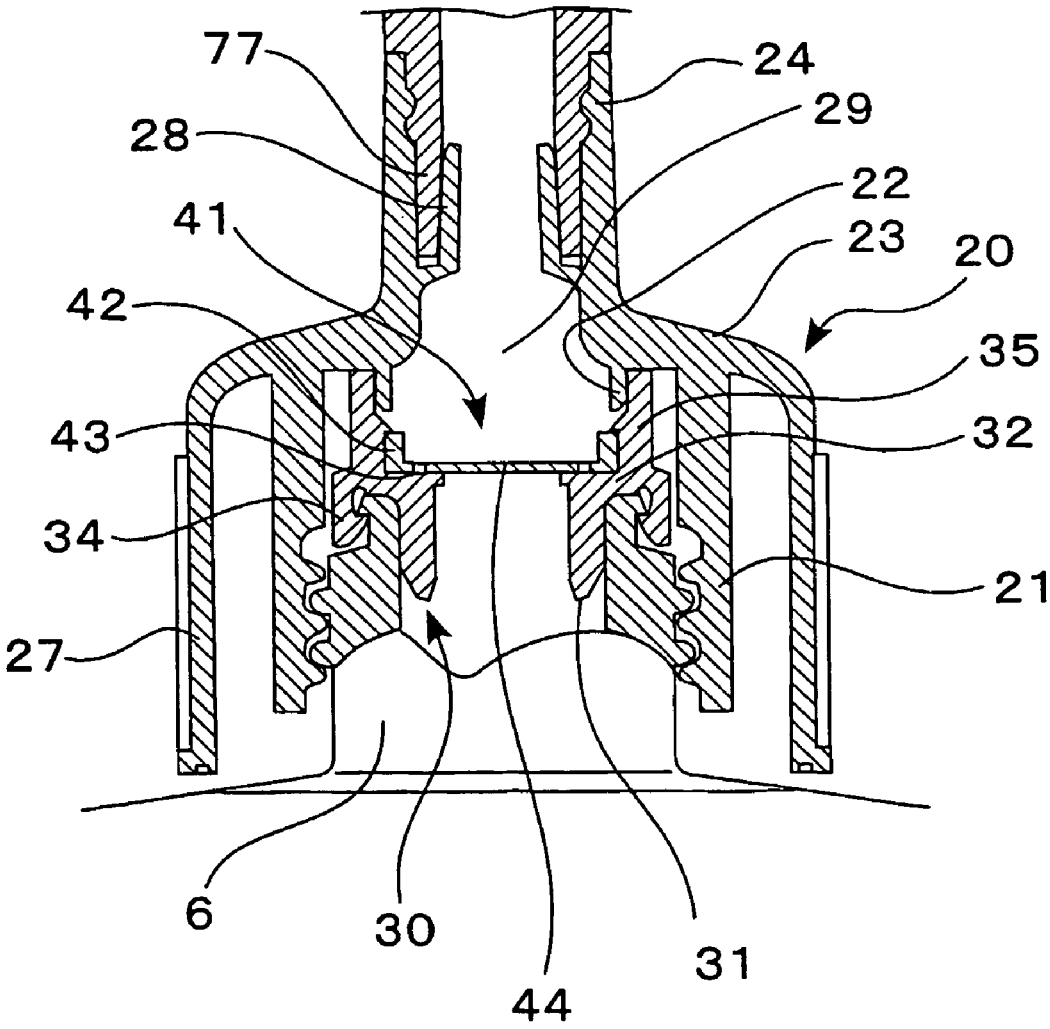
FIG. 4 is a partially enlarged longitudinal section of the important portion at the neck of the discharge container shown in FIG. 2.

As shown in FIG. 4, the second check valve mechanism 41 is disposed at the neck 6 of the container 1 so as to open or close the neck 6. In addition, a discharge section 20 is assembled with and fitted to the neck 6 to accept the comb attachment 72 although this comb attachment 72 may also be directly fitted into the neck 6 of the container 1 without using the discharge section 20.

The second check valve mechanism 41 comprises a ring 42 and a disc-shaped valve 44, which is connected to the ring 42 and connectors 43 and is moved up or down, with the connectors 43 being fixed to the ring 42 at the outer ends to serve as rear anchors. The second check valve mechanism 41 also comprises an internal stopper 30, which is a fitting cylinder for fitting the second check valve mechanism into the container neck 6.

The internal stopper 30 comprises an opening cylinder 31, which has top surface 32 and is suspended inside the container neck 6, a locking cylinder 34, which is suspended outwardly from the top surface and is fitted around the neck 6 by the engagement with the catching groove and the peripheral projecting ridge of the neck 6, and a joining cylinder 35, which stands up from the periphery of the top surface 32.

Projected locking ridge segments are formed on the inner wall of the joining cylinder 35 to fix the upper surface of the ring 42 and to prevent the check valve mechanism 41 from escaping upward. The ring 42 is tightly fitted to the top surface 32 inside the joining cylinder 35, and in this configuration, the check valve 44 comes in tight contact with the top surface 32 and closes the mouth of the opening cylinder 31 and the container neck 6 in a manner that makes it impossible for the contents to flow back and for outside air to creep into the container.

The discharge section 20 comprises an fitting cylinder 22, which is tightly fitted into the joining cylinder 35 of the internal stopper 30, an attaching cylinder 21 having a thread groove, which is notched on the inner wall and is engaged with the screw thread of the container neck 6, an outer wall 27, which is suspended from the shoulder 23 of the discharge section 20 to cover the container neck 6 from the outside, and a discharge cylinder 24 that forms the flow path 29 for the contents. The discharge cylinder 24 is provided with a brim portion, an inner cylinder 28 extending upward from the edge of the brim portion, and an inner peripheral catching ridge disposed at a level above the inner cylinder 28.

A comb attachment 72 having plural teeth 73 is tightly fitted to the discharge cylinder 24. This comb attachment 72 comprises a comb spine 75, the inside of which forms the discharge passage 76 connected to the flow path 29 of the discharge section 20, an inserting portion 77 extending downward from the lower end of this spine 75, the plural teeth 73 that stand on one side of the spine 75 in a row and at equal intervals, and plural discharge holes 74 for discharging the contents into the interspaces of the teeth 73 as soon as the contents flow through the discharge passage 76 and reach the holes 74. The position of the discharge holes 65 is not limited to the interspaces of the teeth 61. Each tooth 73 may also be provided with an inside discharge passage 76 reaching the middle point of the tooth height, and a discharge hole may be disposed at the middle point of the tooth height and in the direction of the row of teeth. Or, the discharge holes 74 may be disposed at any position as long as the contents can be applied onto the hair through the teeth 73.

The inserting portion 77 of the comb attachment 72 is tightly fitted into the inner cylinder 28 of the discharge cylinder 24. At that time, the peripheral catching ridge on the outer wall of the inserting portion 77 is engaged with the inner peripheral catching ridge on the inner wall of the discharge cylinder 24 so that the tight fitting would enhance the sealability of the discharge section 20 and the comb attachment 72.

As shown in FIG. 3, the base cup 50, a cylinder having the bottom of its own, comprises a cylindrical wall 51, which is fitted around the peripheral wall of the bottom cylinder 8 of the container 1, and also comprises the cup bottom plate 53, which is provided with an air hole 54 through which outside air flows in. An inner peripheral locking ridge is disposed in the upper part of the inner peripheral surface of the cylindrical wall 51 and is engaged with the engaging portion on the peripheral wall 9 of the bottom cylinder 8. When the cylindrical wall 51 is fitted around the bottom cylinder 8 of the container 1, the engaging portion and the inner peripheral locking ridge are engaged with each other, and the O-ring 60 is tightly fitted to the inner surface of the cylindrical wall 51. In this configuration, the upper end of the cylindrical wall 51 is in contact with the overhang 7 of the bottom cylinder 8.

A valve-fitting cylinder 55 is disposed so as to stand around the air hole 54 of the base cup 50 and to fix and retain the first check valve mechanism 40 that opens or closes the air hole 54.

Figure 8:
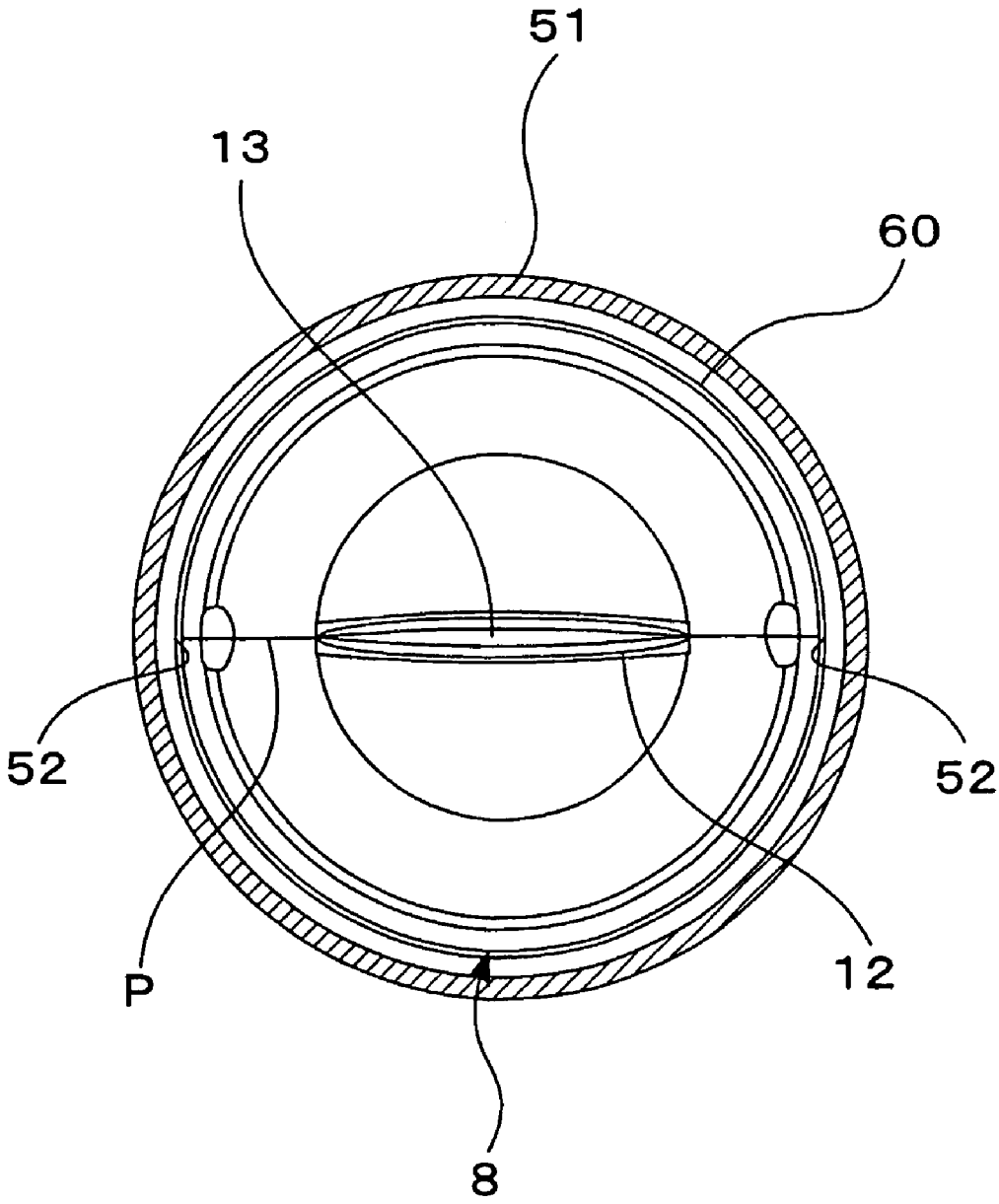
FIG. 8 is an enlarged cross-sectional view taken from line X-X of FIG. 2 showing the bottom of the container.

FIG. 8 is a cross-sectional view taken from line X-X of FIG. 2 showing the bottom of the container 1 in the state in which the base cup 50 has been fitted around the bottom cylinder 8. The cylindrical wall 51 of the base cup 50 has an elliptic shape, with the axis on the parting line P being longer than the axis perpendicular to the parting line P. On the other hand, the pressing mechanism 52 has a cylindrical shape with a diameter shorter than the long axis along the parting line P of the bottom plate 13.

Figure 9:
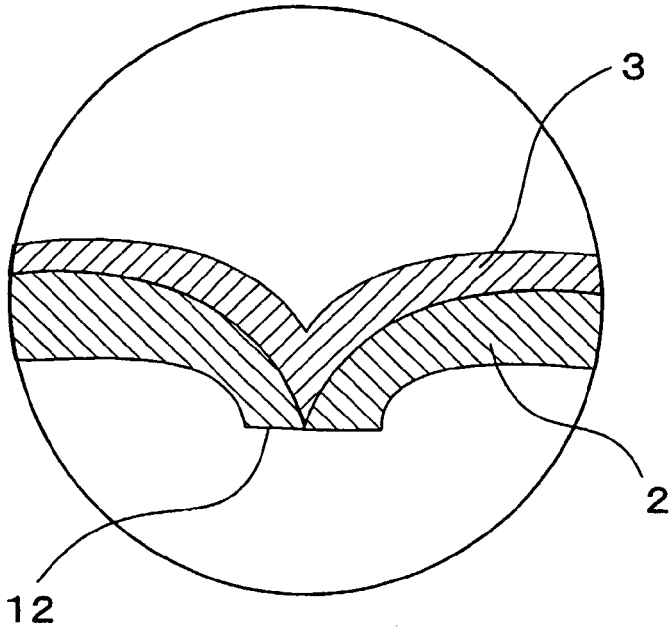
FIG. 9(*a*) is a partially enlarged longitudinal section of the container bottom showing the pinch-off portion on the parting line.
Figure 9:
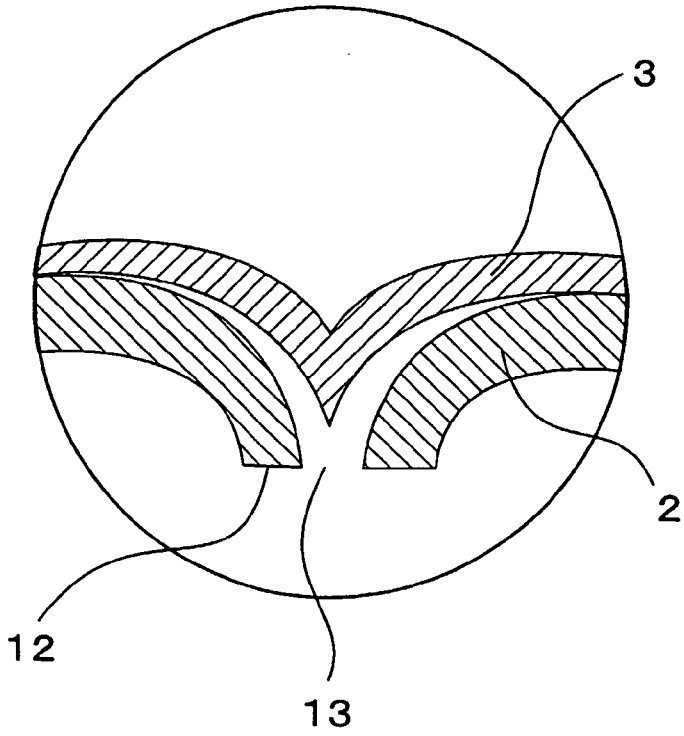

As shown in FIG. 9(*a*), the pinch-off portion 12 of the inner layer 3 and the outer layer 2 that have been sealed together is formed in a ridge along the parting line P and is disposed in the center of the bottom plate 11, which is the underside of the bottom cylinder 8 of the container 1.

As shown in FIG. 9(*b*), the cylindrical wall 51 having the pressing mechanism 52 is forcibly fitted around the bottom cylinder 8 of the container 1. At that time, the pressing mechanism 52 pushes the pinch-off portion 12 along the parting line P so as to open a slit in the pinch-off portion 12. This open slit is used as the air intake 13.

Because the base cup 50 is provided with the pressing mechanism 52, the air intake 13 can be formed in the bottom cylinder 8 in the processing step of fitting the base cup 50 around the bottom cylinder 8 of the container 1. This step reduces the number of processes and increases productivity. In addition to this embodiment, it is also possible to form the air intake 13 beforehand by pressing the pinch-off portion 14 and then to fit the base cup 50 around the bottom cylinder 8.

Even if the pinch-off portion 12 is opened and used as the air intake 13, the base cup 50 having the bottom of its own is fitted around the container bottom cylinder 8 for the reinforcement thereof. Thus, the base cup 50 serves as the outer shell to enhance the mechanical strength of the bottom cylinder 8, without causing any inconvenience, such as the degraded sitting function.

The first check valve mechanism 40 comprises a ring 42, which is fitted tightly in the valve-fitting cylinder 55 of the base cup 50, and also comprises a disc-shaped valve 44, which is connected to this ring 42 and connectors 43 and comes in close contact with the cup bottom plate 53 to cover the air hole 54 opened in the bottom plate 53. The valve 44 acts as a check valve as it is moved up or down, with the connectors 43 being fixed to the ring 42 at the outer ends to serve as rear anchors.

Whichever direction the comb attachment 72 is set in, the inside of the inner layer 3 is always pressurized by the squeeze of the body 4 of the container 1. Then, the container neck 6 is opened by the function of the second check valve mechanism 41, and the contents pass through the flow path 27 of the discharge section 20 and through the discharge passage 76 of the comb attachment 72, and are discharged from the discharge holes 74. The contents, such as a hair dye, can be applied to the hair by combing the teeth 73 through the hair.

When pressure onto the body 4 is released, the inner layer 3 changes from the pressurized state to the depressurized state due to the recovery of the outer layer 2, and outside air and the contents that have passed by the second check valve mechanism 41 tend to be sucked into the inside of the inner layer 3. Since, at that time, the valve 44 acts to close the container neck 6 by the function of the second check valve mechanism 41, outside air is not sucked in, nor the contents flow back into the inside of the inner layer 3.

When the body 4 is released from the pressure of a squeeze, the outer layer 2 begins restoring its original shape due to the resilient recovering force. The inner layer 3, which has broken away from the outer layer 2, does not suck in outside air, but remains deflated and deformed by the function of the second check valve mechanism 41. Therefore, a void between the outer layer 2 and the inner layer 3 is put under the depressurized condition.

Once the void between the outer layer 2 and the inner layer 3 falls into the depressurized condition, the valve 44 of the first check valve mechanism 40, which has closed the air hole 54, moves up or down, with the connectors being fixed at the outer ends to serve as rear anchors, and opens the air hole 54 of the base cup 50. Outside air is introduced into the air intake 13 through this air hole 54, and flows into the void between the outer layer 2 and the inner layer 3. As a result, the outer layer 2 quickly restores its original shape.

When the body 4 of the container 1 is again squeezed, the second check valve mechanism 50 acts to close the air hole 54, and prevents the backflow of the air that has been introduced into the void between the outer layer 2 and the inner layer 3.

The base cup 50 is tightly fitted around the bottom cylinder 8 through the intermediary of the O-ring 60 disposed in the concave groove 10 on the bottom cylinder 8 of the container 1. Because of this O-ring 60, air tightness increases for the gap between the bottom cylinder 8 and the base cup 50. The air introduced from the air hole 54 does not escape outside through this gap.

Therefore, when the body 4 is squeezed, the contents inside the deflated and deformed inner layer 3 are pressurized steadily by way of the air existing between the outer layer 2 and the inner layer 3. At that time, the second check valve mechanism 41 opens the container neck 6 again, and the contents are discharged smoothly from the discharge holes 74 and can be applied to the hair by combing the hair with the teeth 73 of the comb.

Figure 5:
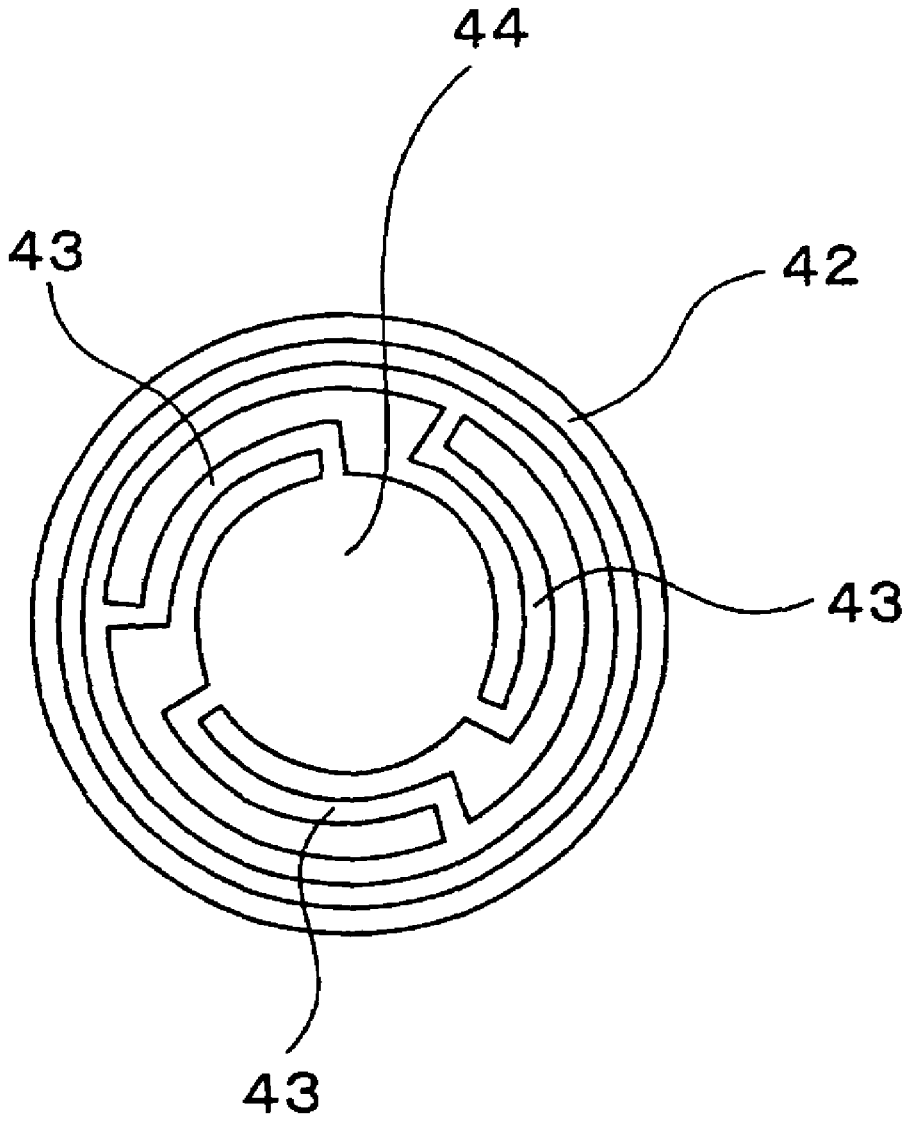
FIG. 5 is an overall plan view showing the first and second check valve mechanisms in a structural embodiment of this invention.

FIG. 5 is a plan view showing an embodiment of the first check valve mechanism 40 and the second check valve mechanism 41. Each mechanism comprises a ring 42 fitted tightly into the cylindrical wall 51 of the base cup 50 or the joining cylinder 35 of the internal stopper 30, and also comprises a disc-like valve 44, which is connected to this ring 42 and connectors 43 and is in close contact with the top surface of the cup bottom plate 53, in which the air hole 54 is opened, or with the top surface 32 of the internal stopper 30. The valve 44 acts as a check valve as it moves up or down, with the connectors being fixed at outer ends to serve as rear anchors.

Figure 6:
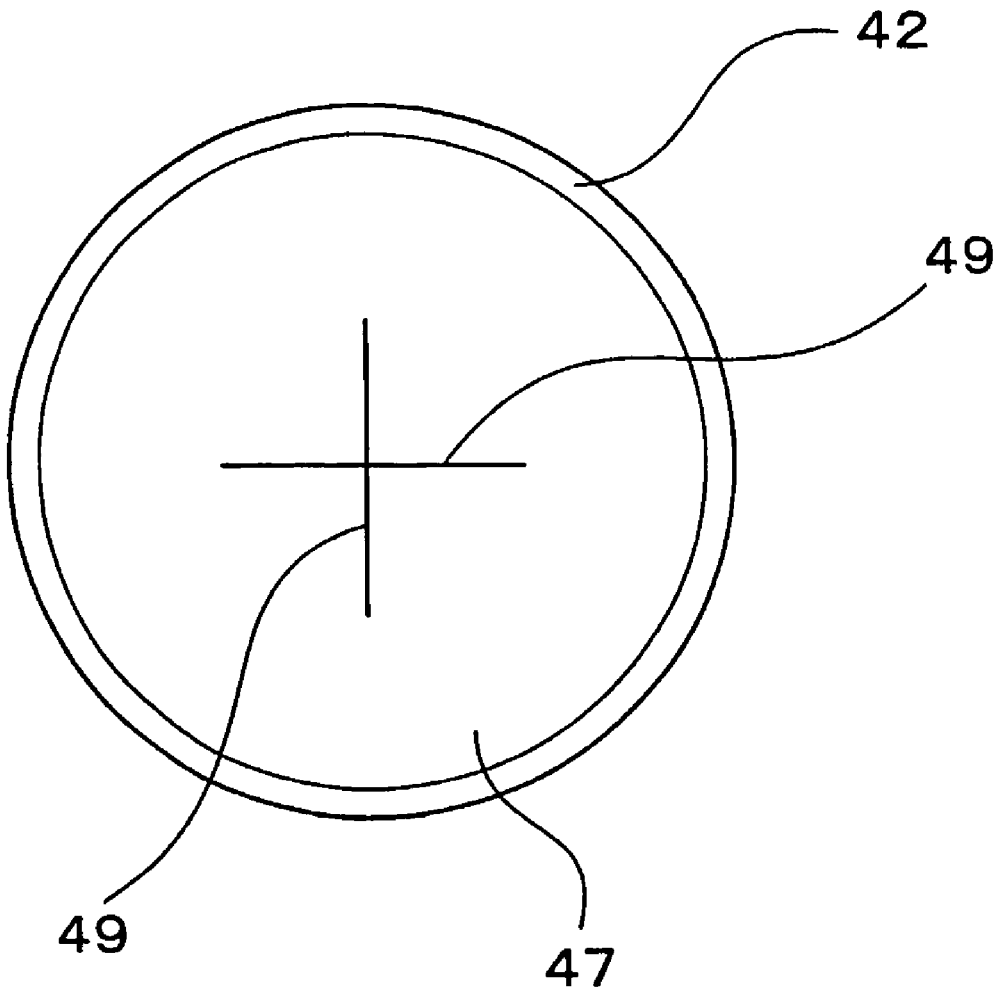
FIG. 6 is an overall plan view showing the first and second check valve mechanisms in another structural embodiment of this invention.

FIG. 6 shows a structural embodiment of both check valve mechanisms 40, 41. Both of the check valves 40, 41 can also be in the structure of a slit valve, which comprises a cross-shaped slit 49 in a slit plate 47 disposed under the ring 42 serving as the fitting portion. This slit 49 is placed to cover the air hole 54 of the base cup 50 or the opening formed by the internal stopper 30. Or, both check valves can be of any structure other than described above as far as they function as check valves.

Figure 10:
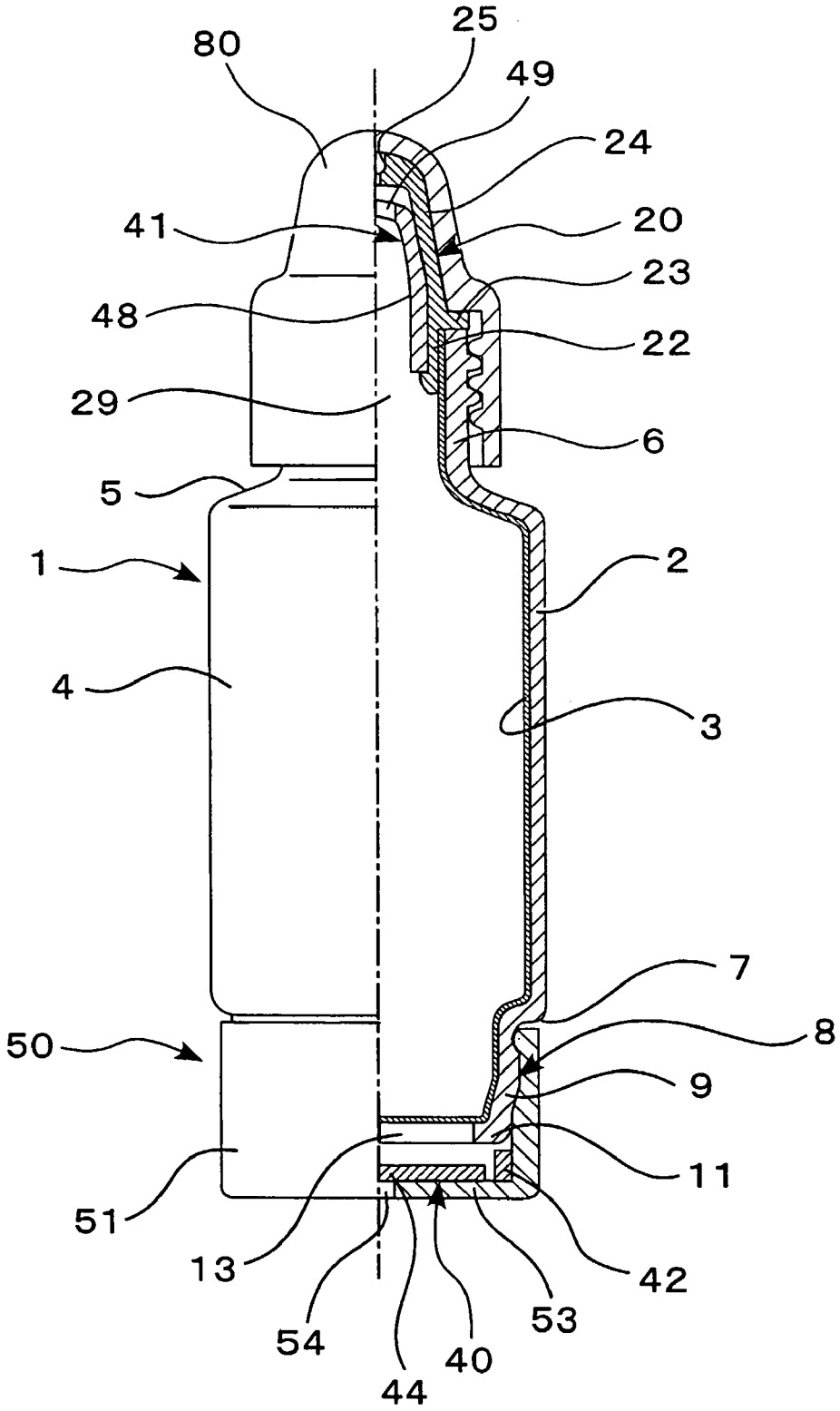
FIG. 10 is a front elevational view of the discharge container in the second embodiment of this invention, with the right half being illustrated in a longitudinal section.

FIG. 10 shows the structure of the discharge container in the second embodiment of this invention. The discharge container comprises the container 1 of the same structure as in the first embodiment, the discharge section 20 fitted into the neck 6 of the container 1, the second check valve 41 in the form of a headed cylinder 48 fitted into the discharge section 20, the base cup 50, and the first check valve mechanism 40. A cap 80 is put on the discharge section 20 and is screwed on the neck 6 of the container 1.

The discharge section 20 comprises a fitting cylinder 22 to be fitted into the neck 6, a top plate 23 disposed around the peripheral wall of the fitting cylinder 22, a discharge cylinder 24 disposed on the top plate 23 so as to reduce its diameter in the upward direction and connected to the container neck 6 to form the flow path 29 for the contents, and a discharge port 25 opened in the head to discharge the contents in drops.

The second check valve mechanism 41 is disposed in the flow path 29 of the discharge section 20. As shown in FIG. 10, the second check valve mechanism 41 is a slit valve comprising a headed attaching cylinder 48 of a bombshell shape fitted in the discharge section 20 that forms the flow path 29 and also comprising a slit 49 disposed at the top of the headed attaching cylinder 48.

Figure 11:
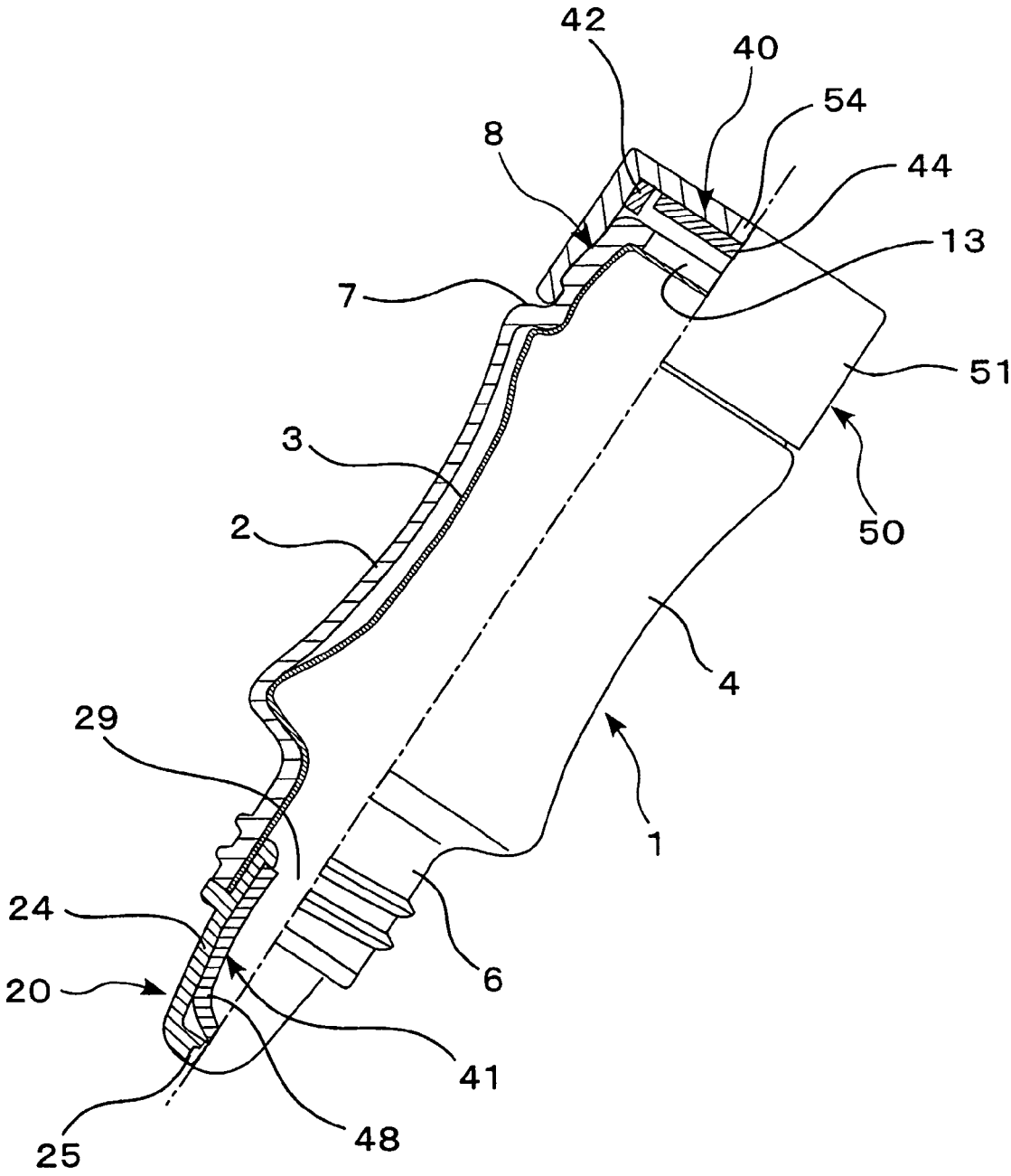
FIG. 11 is an inverted front elevational view of the discharge container of FIG. 10 showing the state in which the container has been squeezed, with the right half being illustrated in the longitudinal section.

FIG. 11 is a schematic diagram showing the movement of the discharge container experienced when the body 4 of the containers is squeezed and deformed. With a squeeze given to the body 4, the inside of the inner layer 3 is pressurized, as shown in FIG. 11. Then, there opens the slit 49 of the second check valve mechanism 41, which is the slit valve, and eye drops, the contents, are discharged in drops from the discharge port 25.

When pressure onto the body 4 is released, the inner layer 3 changes from the pressurized state to the depressurized state, and outside air tends to be sucked into the inside of the inner layer 3. Since, at that time, the second check valve mechanism 41 acts to close the slit 49, outside air is not sucked in, nor the contents flow back.

Figure 12:
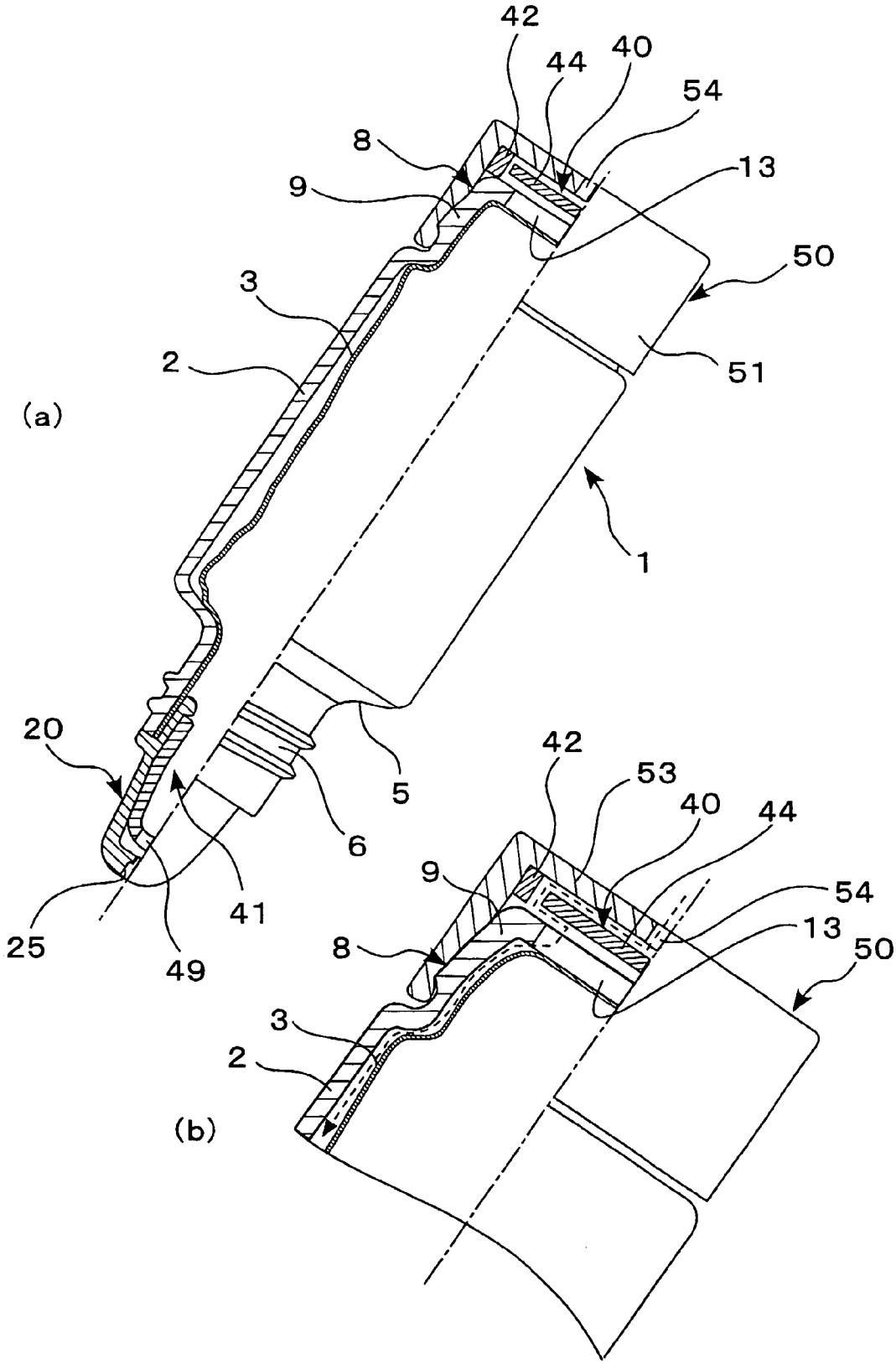
FIG. 12(*a*) is an inverted front elevational view of the discharge container of FIG. 10 in the state in which the pressure has been released after the squeeze, with the right half being illustrated in the longitudinal section.

When the body 4 is released from the pressure of a squeeze, the outer layer 2 resiliently restores its original shape due to the ability of self-shape retention. On the other hand, the inner layer 3 does not suck in outside air, but remains deflated and deformed with the decrease in the contents. Therefore, a void is formed between the outer layer 2 that returns to its original shape and the inner layer 3 that remains deflated. (See FIG. 12(*a*).)

Because of this resilient, restoring force of the outer layer 2, the void falls into a reduced pressure condition. Then, the valve 44 of the first check valve mechanism 40 moves up or down, with the connectors being fixed at the outer ends to serve as rear anchors, and opens the air hole 54 of the base cup 50. Outside air is introduced into the air intake 13 through this air hole 54, and flows into the void between the outer layer 2 and the inner layer 3. (See FIG. 12(*b*).)

When the body 4 of the container 1 is again squeezed, the void between the outer layer 2 and the inner layer 3 is pressurized. Then, the first check valve mechanism 40 operates, and the valve 44 closes the air hole 54. As a result, the first check valve mechanism 40 blocks up the connection between the air intake 13 and outside air, and at the same time, prevents the backflow of the air that has been introduced into the void between the outer layer 2 and the inner layer 3.

The squeeze of the outer layer 2 pressurizes steadily the contents inside the deflated and deformed inner layer 3 by way of the air existing between the outer layer 2 and the inner layer 3. Then, the slit 49 of the second check valve mechanism 41 opens to allow the contents to be discharged from the discharge port 25.

Figure 13:
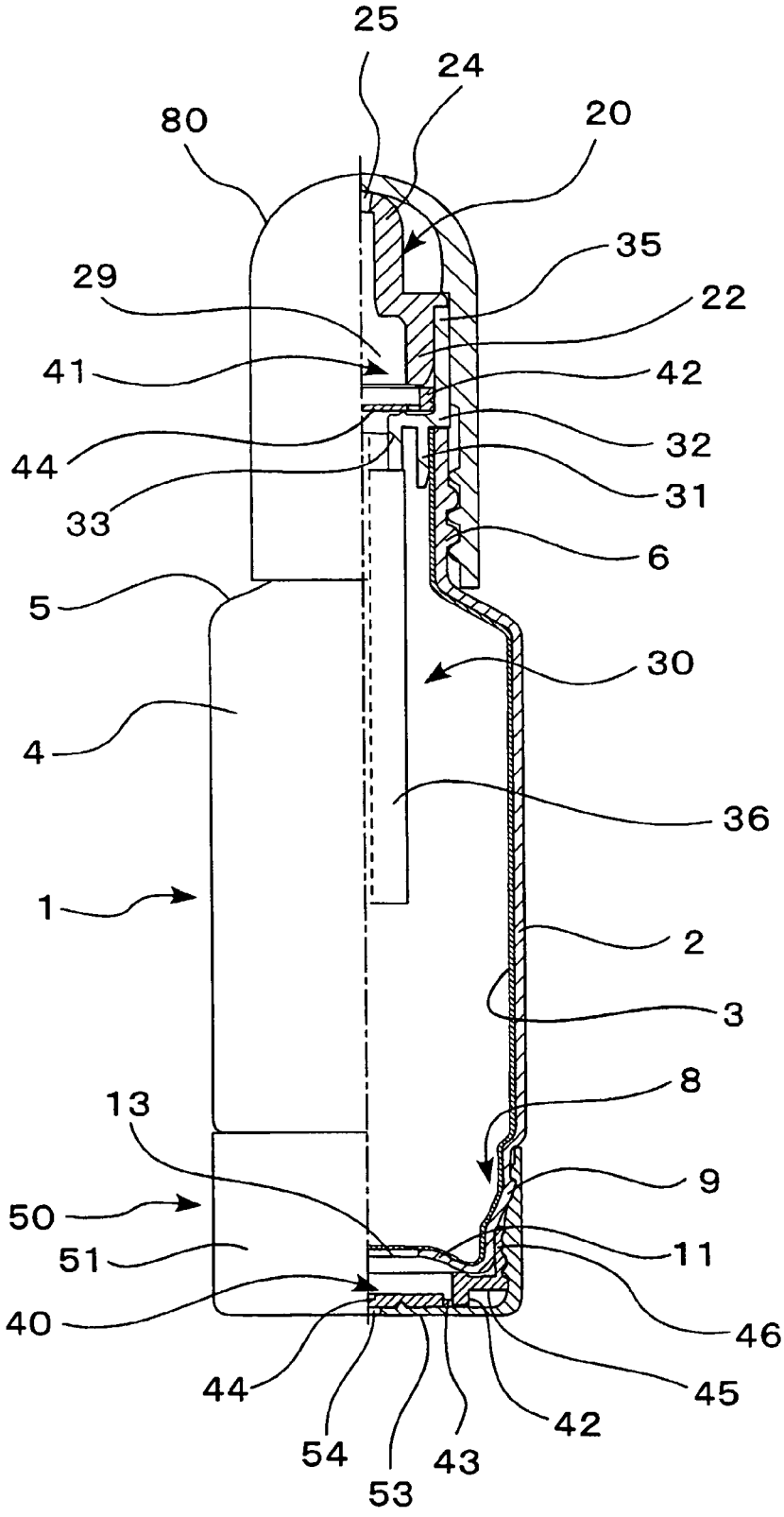
FIG. 13 is a front elevational view of the discharge container in the third embodiment of this invention, with the right half being illustrated in the longitudinal section.

FIG. 13 is a front elevational view of the discharge container in the third embodiment of this invention, with the right half being illustrated in a longitudinal section. As shown in FIG. 13, the internal stopper 30 is fitted into the neck of the container 1, and is provided with a rod 36, which extends down to a nearly middle point in the vertical direction of the container 1. As far as the rod 36 serves to maintain a passageway for the flow of contents through the opening cylinder, the length of this rod 36 is not limited to the middle point of the container in the vertical direction, but can be close to the lower end of the stopper 30, or the rod may have a length reaching the bottom cylinder 8.

Figure 15:
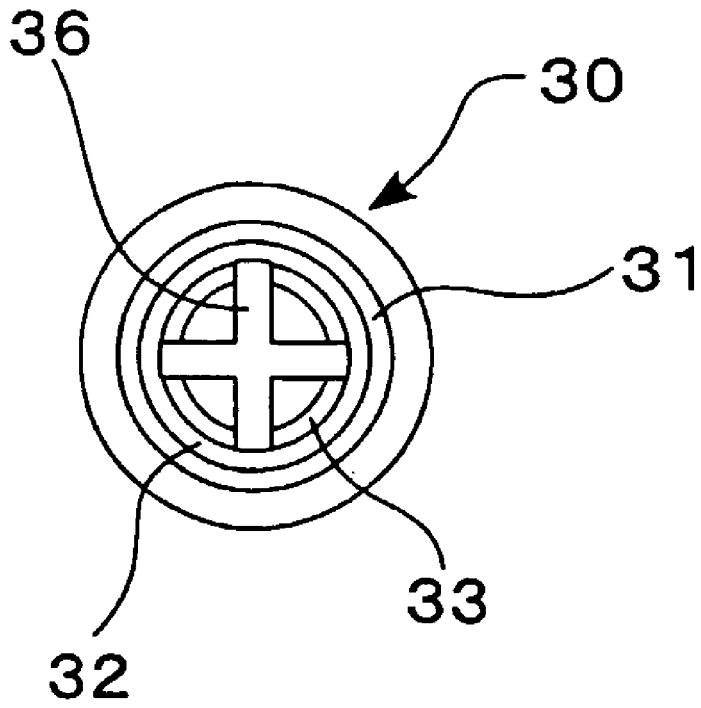
FIG. 15 is a plan view showing the upper end of the internal stopper used in the embodiment shown in FIG. 13.

The internal stopper 30 comprises the inletting cylinder 31, which has top surface 32 and which is fitted into the neck 6 of the container 1 to make the internal stopper 30 assembled and fitted to the neck 6; the opening cylinder 33, which is suspended from the innermost portion of the top surface 32 of the inletting cylinder 31; the rod 36, which has a cross pattern at the upper end and is disposed under the opening cylinder 33 to form a passageway to allow the liquid contents to flow through this opening cylinder 33 (See FIG. 15); and the intermediary cylinder 35 that stands up from the peripheral edge of the top surface 32. The upper end of the rod 36 is not limited to the cross pattern, but can be straight lines or a more complicated grid pattern, and the rod 36 may have any shape at the upper end.

The discharge section 20 is fitted tightly in the neck 6 of the container 1 when the fitting cylinder 22 is fitted into the intermediary cylinder 35 of the internal stopper 30. The rod 36 secures the flow path 29 for the discharge of the contents even if the deflation and deformation of the inner layer 3 is in progress with the decrease in the contents.

The second check valve mechanism 41 of a structure shown in FIG. 5 is disposed in the intermediary cylinder 35 of the internal stopper 30.

The first check valve mechanism 40 shown in FIG. 5 is disposed inside the base cup 50 and is molded integrally from a soft, resilient material, together with a gasket 46 standing up from the upper end of the ring 42 by way of an outer brim 45.

The gasket 46 is fitted around the wall 9 of the bottom cylinder 9 of the container 1 and is also fitted in the cylindrical wall 51 of the base cup 50. Since the gasket 46 made of a soft, resilient material is sandwiched between the wall 9 of the bottom cylinder 8 and the cylindrical wall 51, outside air fails to pass the gap between these portions, and the air introduced from the air hole 54 does not escape outside through the gap.

Figure 14:
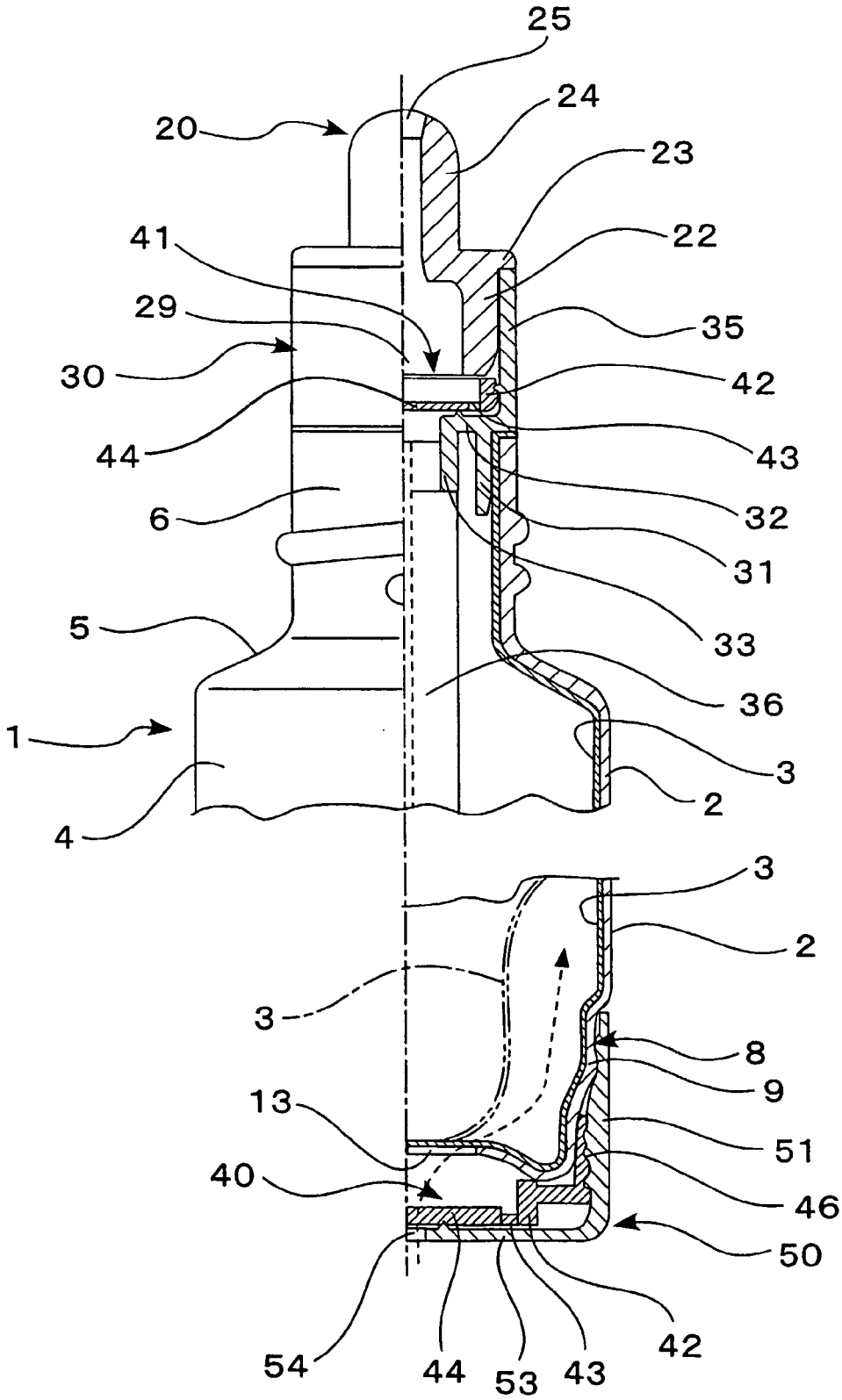
FIG. 14 is partial front elevational views of the discharge container showing the neck and bottom portions in the state in which pressure has been released after the squeeze, with the right half being illustrated in the longitudinal section.

The first check valve mechanism 40 performs its check valve function so that air introduce through the air hole 54 is not allowed to escape outside, but is allowed to retained in the void between the deflated and deformed inner layer 3 and the outer layer 2. (See FIG. 14.)

When the container 1 is squeezed and deformed, the first check valve 40 operates so as to prevent the backflow of air from the air hole 54, without allowing air to escape through the gap of the base cup 50, which is fitted around the bottom cylinder 8 of the container 1. Thus, the squeeze of the outer layer 2 ensures that the contents are pressurized and that smooth discharge operations of the discharge container can be maintained.

Figure 16:
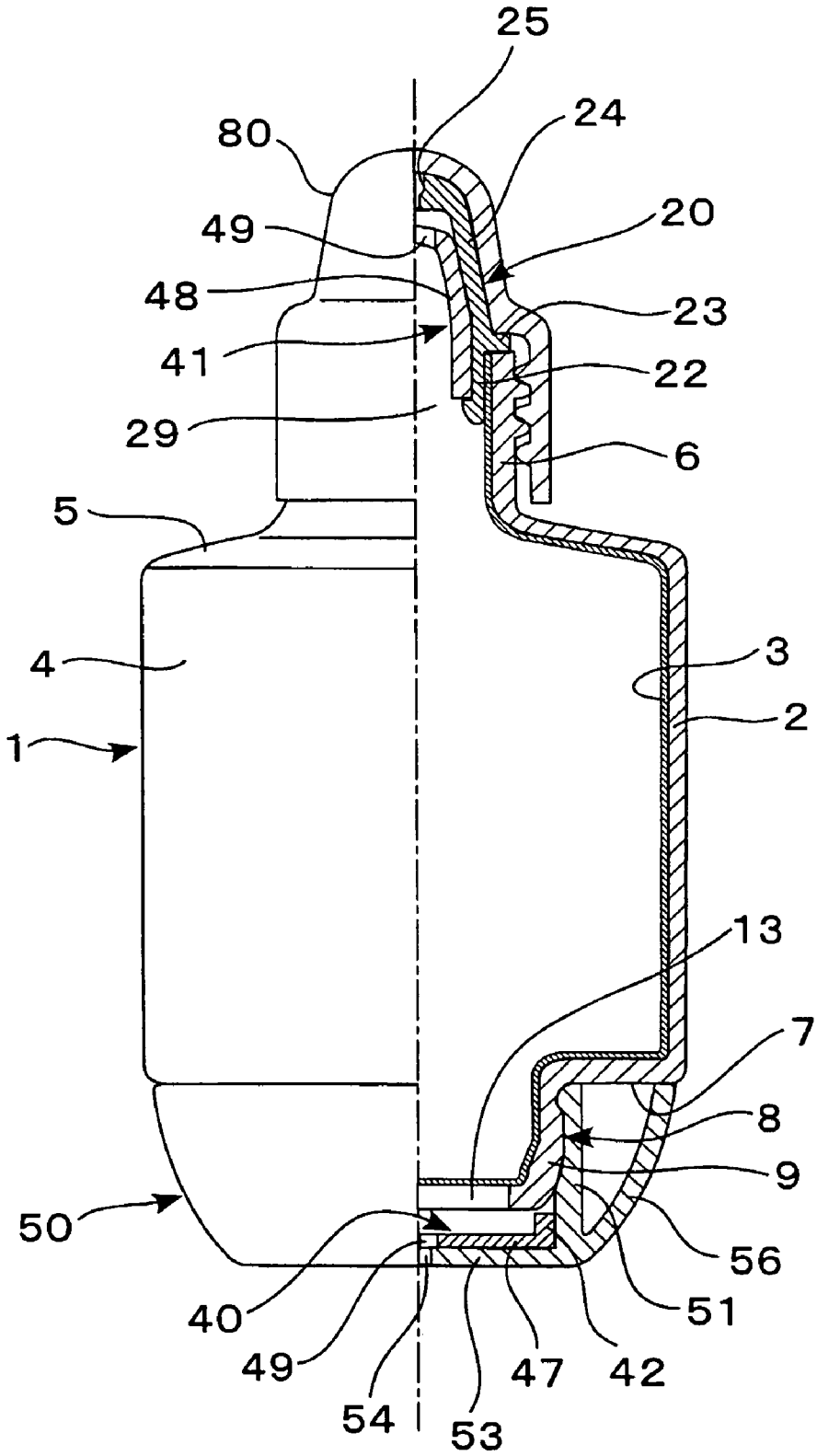
FIG. 16 is a front elevational view of the discharge container in the fourth embodiment of this invention, with the right half being illustrated in the longitudinal section.

FIG. 16 shows the discharge container in the fourth embodiment of this invention. An enlarged overhang 7 is disposed on the bottom cylinder 8 of the container 1. An outer cylinder 56 surrounds the cylindrical wall 51 of the base cup 50 and stands up from the periphery of the cup bottom plate 53 in such a way that the wall of the outer cylinder 56 supports the peripheral edge of the overhang 7 from underneath.

Figure 7:
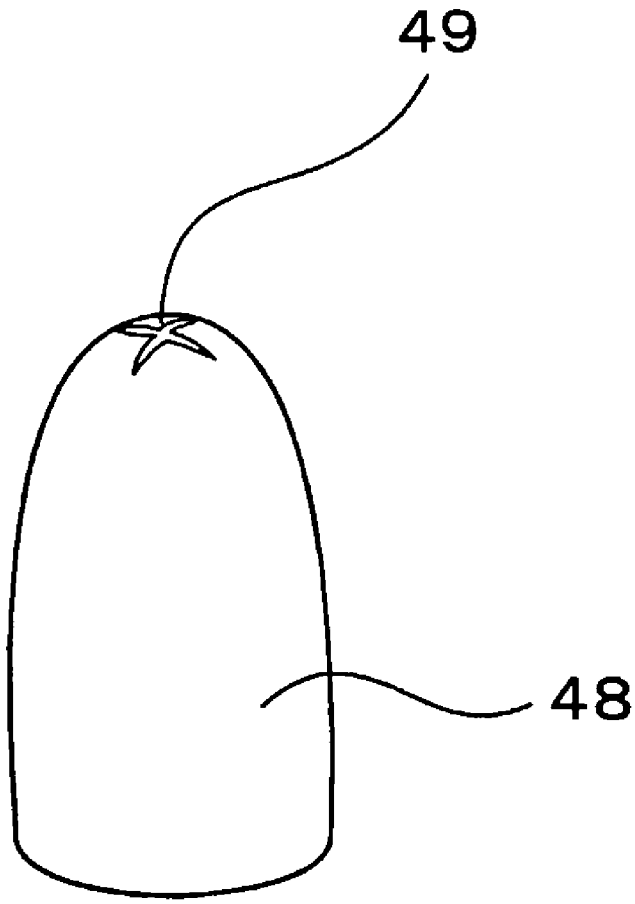
FIG. 7 is an overall perspective view showing the second check valve mechanism in still another embodiment of this invention.

In this embodiment, use is made of the first check valve mechanism 40 comprising the ring 42 and the slit plate 47 having the slit 49, as shown in FIG. 6, and the second check valve mechanism 41 comprising the headed cylinder 48, as shown in FIG. 7. The entire structure is simple, and the discharge container of a fully small size can be obtained at a low cost.

Since the bottom cylinder 8 of the container 1 is surrounded doubly by the cylindrical wall 51 of the base cup 50 and by the outer cylinder 56, the base cup 50 shows an improved reinforcing function as the shell. As a result, the bottom cylinder 8 of the container 1 is mechanically stabilized, and experiences no inconvenience of buckling.

Figure 17:
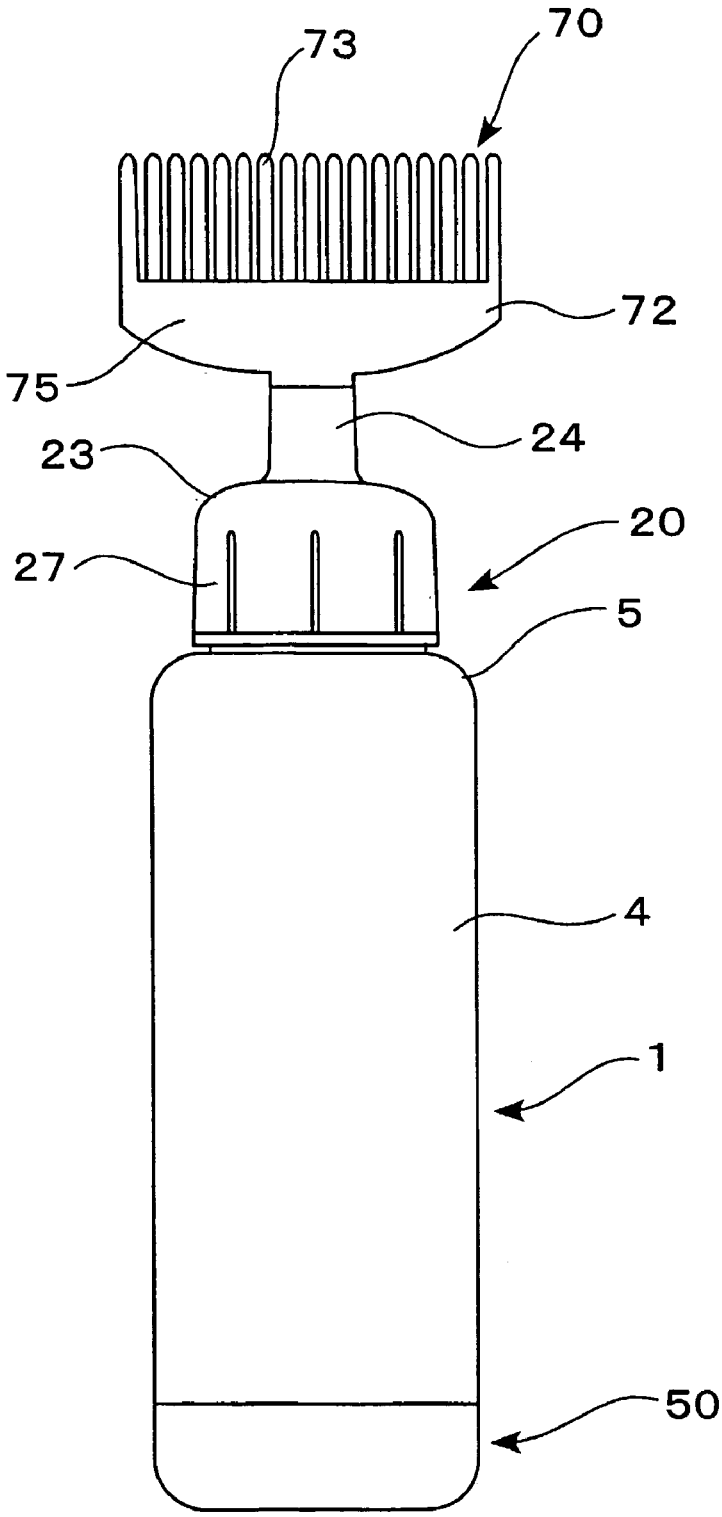
FIG. 17 is a front elevational view of the entire discharge container in an embodiment in which the attached applicator is a comb with the teeth disposed on top of the comb.

FIG. 17 is a front elevational view of the discharge container attached with an applicator 70 in another embodiment of this invention. As shown in FIG. 17, a comb attachment 72 having teeth 73 is disposed on the topside of the comb spine 75. In this embodiment, it is possible to mold the comb 72 integrally. Due to the arrangement of the discharge passage for the contents, it is also possible to discharge the contents almost equally in the interspaces of the teeth 73.

Figure 18:
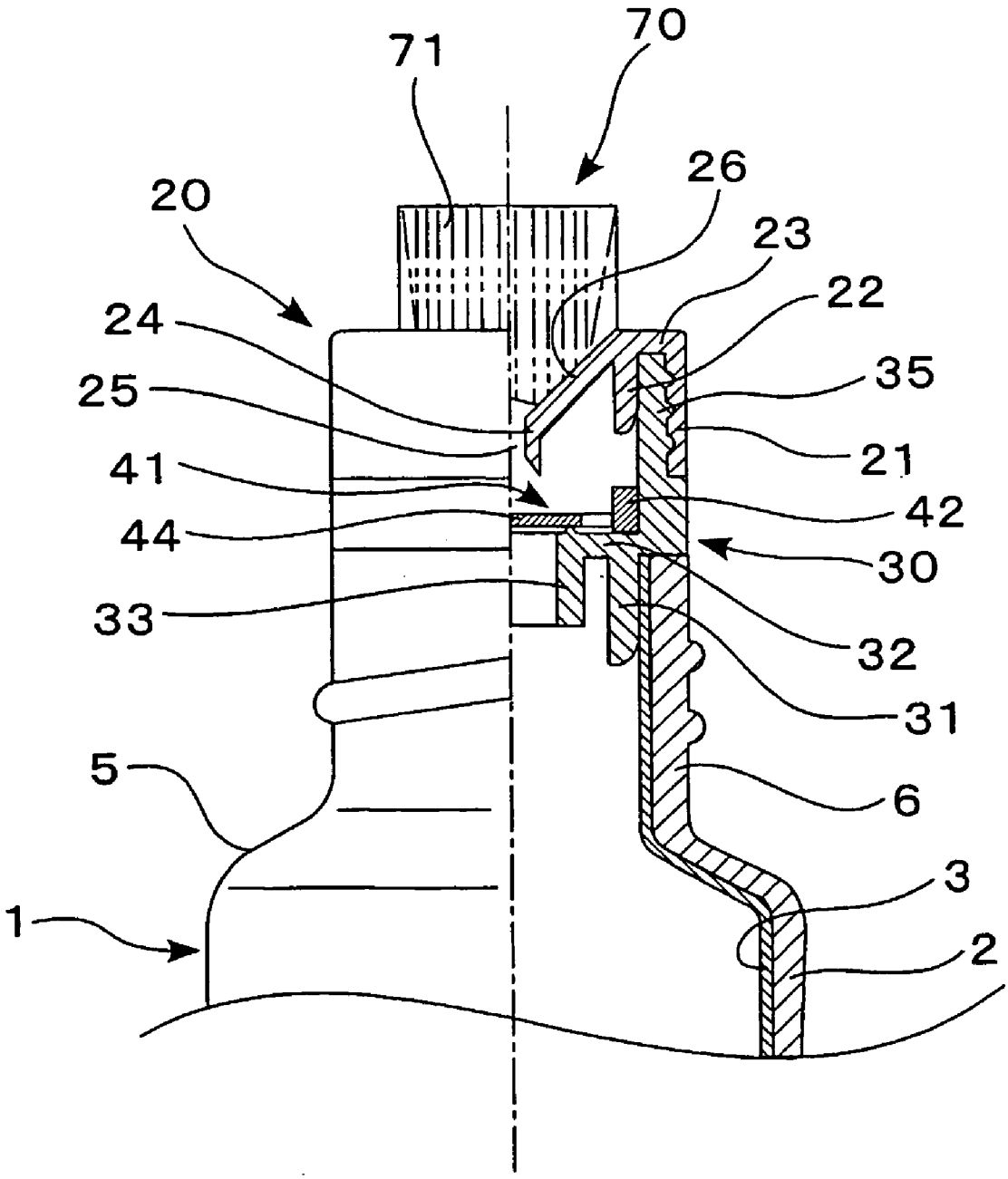
FIG. 18 is a partial front elevational view of the discharge container in the embodiment, in which a brush is fitted to the top of the container, with the right half being illustrated in the longitudinal section.

FIG. 18 shows an applicator 70 in still another embodiment to be fitted to the discharge container of this invention.

A screw thread is notched on the outer surface of the intermediary cylinder 35 of the internal stopper 30. The discharge section 20 comprises a fitting cylinder 22, which is suspended to fit into the intermediary cylinder 35, and also comprises a connecting cylinder 21, which is provided with a locking ridge to be screwed together with the screw thread on the intermediary cylinder 35 on contact with the fitting cylinder 22 and the top plate 23. Inside this fitting cylinder 22 there is a tapered cylinder 26 of a hopper type, which is centrally disposed. Discharge port 25 is located in the center and at the lowest point of this tapered cylinder 26, which is provided with a brush 71 with hair implant on the upper tapered surface. The applicator 70 may be directly fitted to the neck 6 of the container 1, or the applicator can take various other shapes, such as those described below.

Since the applicator 70 is disposed at the discharge section 20, the contents can be directly applied to the target area by means of the brush applicator 70 when the contents are discharged through the discharge port 25 by squeezing the container 1. Thus, the discharge container has improved convenience of use and ease of operation. The applicator 70 is not limited to the brush type, but also includes porous sponge, a semi-spherical head having a massaging effect, and the like. It is desirable to have an applicator that is effective and suitable for the intended purpose of the contents to be put in the discharge container.

INDUSTRIAL APPLICABILITY

This invention having the above-described configuration has the following effects:

According to an exemplary aspect, the first check valve mechanism operates to fill air smoothly in the void between the outer layer and the inner layer that has broken away from the outer layer. Since the outer layer quickly restores its original shape, it is possible to maintain good outer appearance of the container.

Even if the air intake is opened in the bottom of the container, the container can be made to have its stable bottom shape because the container bottom is reinforced with the base cup, which is fitted around the bottom cylinder of the container.

According to another exemplary aspect, the second check valve acts to discharge the contents with the squeeze and deformation of the container. When the pressure onto the container is released, the second check valve prevents the backflow or the contents and the entry of outside air. Since the void between the outer layer and the deformed inner layer is filled with air because of the function of the first check valve, the squeeze of the outer layer ensures that the contents are pressurized and discharged smoothly to the last drop. Thus, there is provided a discharge container having ease of discharge operation.

According to a further exemplary aspect, the base cup is fitted around the bottom cylinder of the container through the intermediary of the O-ring, which makes tight fitting easy and reliable.

When the container is deformed by the squeeze, air introduced through the air hole is prevented from escaping through the gap between the bottom cylinder and the base cup. The contents inside the inner layer are steadily pressurized by the squeeze of the outer layer. Thus, the smooth discharge operation for the contents can be maintained.

According to another exemplary aspect, an air hole is disposed in the base cup bottom, which is tightly fitted around the bottom cylinder of the container. In this configuration, the base cup stably reinforces the bottom cylinder of the container. The first check valve mechanism can be fitted to the base cup favorably and easily.

According to a further exemplary aspect, elasticity of the connectors can be set so freely that the check valve mechanisms are able to move at any desired sensitivity. Thus, smooth and favorable operation is available for the discharge container.

According to another exemplary aspect, the check valves can be obtained easily at a less expensive cost because the check valve mechanisms have a simple configuration.

According to a further exemplary aspect, the gasket is an essential part of the first check valve mechanism, and can be used to fit the base cup tightly to the container. Because of this gasket, the configuration can be simplified for the tight fitting of base cup to the container.

According to another exemplary aspect, the air intake can be formed simply and properly in the bottom of the discharge cylinder, without causing the mechanical strength to be lowered.

According to a further exemplary aspect, the air intake can be opened in the bottom of the container by fitting the base cup to the container. Since no additional work process is required to open the air intake, the discharge container production processes can be simplified.

According to another exemplary aspect, the discharge section fitted to the neck of the container is free to form any desired discharge port. Therefore, it is possible to allow the discharge container to respond flexibly to the purpose of use.

For instance, the discharge section having the discharge port at the tip can be formed into a slim cylinder, which is suitable to discharge the contents in drops. Thus, the discharge container of this invention can be used favorably as an eyedropper.

According to a further exemplary aspect, the contents are discharged from the container and can be applied easily and directly to the intended place by utilizing the applicator.

According to another exemplary aspect, the contents are discharged in the interspaces of the teeth, and can be applied to the hair by passing the comb through the hair. Thus, it becomes quite simple to apply the contents to the hair.

According to the further exemplary aspect, plural teeth are disposed on one side of the comb spine. The contents can be applied to the hair by holding the container body with a hand and combing the teeth through the hair in the same way as using an ordinary comb.

According to another exemplary aspect, the teeth are disposed on top of the comb spine. This makes it easy to mold the comb integrally as the one having the teeth and the discharge holes for discharging the contents into the interspaces of the teeth.

According to a further exemplary aspect, a brush is used as the applicator. The discharged contents can be applied directly to the surface by using this brush.

According to another exemplary aspect, the second check valve mechanism can be fitted properly and easily in the configuration using the discharge section. The structure can be much more simplified to fit the second check valve mechanism.

According to a further exemplary aspect, the discharge and consumption of the contents can be favorably maintained to the last because the contents can be steadily and smoothly discharged to the last drop.

According to another exemplary aspect, there can be obtained the second check valve mechanism of quite a simple structure, and there can be also provided a check valve of quite a small diameter. Thus, it becomes possible for the second check valve mechanism to be located at a position fully close to the discharge port that has been opened at the tip of a slim discharge cylinder. It is also possible for the contents remaining outside the second check valve mechanism to be reduced to a much less amount.

According to a further exemplary aspect, the outer layer of the container quickly restores its original shape because of the function of the first check valve. Even if the container is of a small size, it has the ease of operation. Furthermore, because the second check valve prevents outside air from creeping inside the inner layer, the container is highly sanitary and most suitable for use as an eyedropper.

The invention claimed is:

1. A discharge container comprising:

a container having an outer layer and an inner layer that is laminated with the outer layer so that the inner layer is peelable from the outer layer;

a container neck that is disposed on top of the container and used to form a flow path for contents of the container, an air intake that is disposed in a part of the outer layer constituting a bottom cylinder, the air intake used to introduce outside air into a void between the outer layer and the inner layer;

a base cup that is fitted around the bottom cylinder;

a first check valve that is assembled with and fitted to the base cup so as to allow outside air to pass through the air intake but not to allow backflow of the outside air through the air intake; and a second check valve disposed in a neck of the container, wherein the container is squeezable, wherein the second check valve opens or closes a flow path so that it is impossible for the contents to flow back and for the outside air to creep into the container, wherein a pinch-off is formed in the outer layer along a parting line under a bottom plate of the bottom cylinder of the container, and wherein the pinch-off is opened and used as the air intake.

2. The discharge container according to claim 1, wherein an outer peripheral wall of the bottom cylinder is provided circumferentially with a concave groove, into which an O-ring is fit tightly in order to fit the base cup tightly around the bottom cylinder of the container.

3. The discharge container according to claim 1, wherein the base cup that includes a cylinder having a bottom at a lower closed end, is tightly fitted around the bottom cylinder of the container, and wherein an air hole for introducing outside air is disposed in a cup bottom plate of the base cup.

4. The discharge container according to claim 1, wherein the first check valve and the second check valve each include a ring and a valve, which is connected to the ring and connectors, wherein the valve is moved up or down, and wherein the connectors are fixed at outer ends of the ring to serve as rear anchors.

5. The discharge container according to claim 1, wherein the first check valve and the second check valve each include a ring and a slit plate, the slit plate being integrally disposed together with the ring and being provided with a slit that acts as a valve.

6. The discharge container according to claim 1, wherein the first check valve is molded integrally with a gasket from a soft, elastic material, the gasket being fitted around the bottom cylinder of the container and also fitted into a cylindrical wall of the base cup so that the base cup can be tightly fitted around a peripheral wall of the bottom cylinder of the container.

7. The discharge container according to claim 1, wherein a pressing mechanism is disposed in the base cup to apply a pressure on the bottom plate of the container in a direction along a parting line.

8. The discharge container according to claim 1, wherein a discharge section is fitted into the neck of the container and is provided with a discharge port and the flow path, which is a discharge passage for the contents of the container.

9. The discharge container according to claim 8, wherein an applicator is disposed at the discharge port of the discharge section to apply the discharged contents to an intended place.

10. The discharge container according to claim 9, wherein the applicator is a comb having a row of teeth and discharge holes through which the contents are discharged in the interspaces of the teeth, the comb having a discharge passage formed inside a comb spine and communicated with the flow path of the discharge section.

11. The discharge container according to claim 10, wherein the row of teeth is disposed on one side of the comb spine.

12. The discharge container according to claim 10, wherein the row of teeth is disposed on top of the comb spine.

13. The discharge container according to claim 9, wherein the applicator is a brush having hair implanted on an upper surface of a tapered cylinder and having the discharge port opened in the tapered cylinder of the discharge section.

14. The discharge container according to claim 8, wherein an internal stopper includes a top wall in the shape of a ring plate, which is disposed at an upper end of an inletting cylinder to be tightly fitted into the neck of the container and is used as a valve seat for the second check valve, and includes an intermediary cylinder, which stands up from a periphery of the top wall and is connected to the discharge section.

15. The discharge container according to claim 14, wherein the internal stopper includes an opening cylinder, which is suspended from an inner edge of a top wall of the inletting cylinder, and includes a rod, which is disposed under the opening cylinder and has a passageway to allow the contents to pass between the rod and the opening cylinder.

16. The discharge container according to claim 8, wherein the second check valve includes a slit, which is used as an opening and is disposed at a peak of a headed cylinder to be assembled with and tightly fixed to a discharge cylinder of the discharge section.

17. The discharge container according to claim 8, wherein the contents are eye drops.

* * * * *

UNITED STATES PATENT AND TRADEMARK OFFICE

CERTIFICATE OF CORRECTION

PATENT NO. : 7,293,674 B2
APPLICATION NO. : 10/505134
DATED : November 13, 2007
INVENTOR(S) : Takayuki Abe et al.

It is certified that error appears in the above-identified patent and that said Letters Patent is hereby corrected as shown below:

On the title page, item [54] and column 1, line 1, the title should read:
-- DISCHARGE CONTAINER --.

Signed and Sealed this

Twenty-fourth Day of February, 2009

JOHN DOLL
*Acting Director of the United States Patent and Trademark Office*